US007517848B2

(12) United States Patent
Evans et al.

(10) Patent No.: US 7,517,848 B2
(45) **Date of Patent: *Apr. 14, 2009**

(54) MULTIUSE, SOLID CLEANING DEVICE AND COMPOSITION

(75) Inventors: K Donald Evans, South Jordan, UT (US); Cory E. Cook, Riverton, UT (US)

(73) Assignee: Eco-Safe Technologies, LLC, South Jordan, UT (US)

( * ) Notice: Subject to any disclaimer, the term of this patent is extended or adjusted under 35 U.S.C. 154(b) by 349 days.

This patent is subject to a terminal disclaimer.

(21) Appl. No.: 11/535,896

(22) Filed: Sep. 27, 2006

(65) Prior Publication Data

US 2007/0232517 A1 Oct. 4, 2007

Related U.S. Application Data

(63) Continuation-in-part of application No. 10/597,837, filed as application No. PCT/US2005/004133 on Feb. 10, 2005, which is a continuation-in-part of application No. 10/775,264, filed on Feb. 10, 2004, now Pat. No. 7,053,040, and a continuation-in-part of application No. 10/925,331, filed on Aug. 24, 2004, now abandoned.

(51) Int. Cl.

| | |
|---|---|
| ***C11D 17/04*** | (2006.01) |
| ***C11D 17/00*** | (2006.01) |
| ***C11D 9/42*** | (2006.01) |
| ***C11D 3/08*** | (2006.01) |
| ***B08B 9/28*** | (2006.01) |

(52) U.S. Cl. ..... 510/447; 8/137; 134/25.2; 510/378; 510/377; 510/507; 510/511; 510/532; 510/509; 510/531; 510/218; 510/219; 510/220; 510/224; 510/225

(58) Field of Classification Search ..... 510/378, 510/377, 447, 507, 511, 532, 509, 531, 218, 510/219, 220, 224, 225; 8/137; 134/25.2
See application file for complete search history.

(56) References Cited

U.S. PATENT DOCUMENTS

| | | | | |
|---|---|---|---|---|
| 3,507,624 | A | | 4/1970 | Schneider, Jr. et al. |
| 3,640,876 | A | | 2/1972 | Donaghu |
| 3,649,545 | A | | 3/1972 | Suski et al. |
| 3,715,314 | A | | 2/1973 | Morgenstern |
| 3,726,304 | A | | 4/1973 | Cook |
| 3,772,193 | A | | 11/1973 | Nelli et al. |
| 4,397,777 | A | | 8/1983 | Yurko |
| 4,532,722 | A | | 8/1985 | Sax |
| 4,569,780 | A | | 2/1986 | Fernholz et al. |
| 4,753,755 | A | | 6/1988 | Gansser |
| 4,826,661 | A | | 5/1989 | Copeland et al. |
| 5,118,439 | A | | 6/1992 | Urfer et al. |
| 5,310,430 | A | | 5/1994 | McCall, Jr. |
| 5,316,692 | A | | 5/1994 | John |
| 5,338,528 | A | | 8/1994 | Sorensson et al. |
| 5,342,587 | A | * | 8/1994 | Laughlin et al. ..... 422/266 |
| 5,344,633 | A | | 9/1994 | Sorensson et al. |
| 5,355,541 | A | | 10/1994 | Rutter et al. |
| 5,393,446 | A | | 2/1995 | Matsumoto |
| 5,443,751 | A | | 8/1995 | Maxxola |
| 5,650,013 | A | | 7/1997 | Gordon et al. |
| 5,665,694 | A | | 9/1997 | Backes et al. |
| 5,711,920 | A | | 1/1998 | Barford et al. |
| 5,755,330 | A | | 5/1998 | Siragusa et al. |
| 5,768,917 | A | | 6/1998 | Freida |
| 5,801,137 | A | | 9/1998 | Addison et al. |
| 5,810,043 | A | | 9/1998 | Grenier |
| 5,827,434 | A | | 10/1998 | Yando |
| 5,839,298 | A | | 11/1998 | Duquet |
| 5,870,906 | A | | 2/1999 | Denisar |
| 5,873,268 | A | | 2/1999 | Spriggs et al. |
| 5,916,866 | A | | 6/1999 | Davies et al. |
| 5,924,151 | A | | 7/1999 | Connan |
| 5,946,951 | A | | 9/1999 | Watanabe |
| 5,962,389 | A | | 10/1999 | Partee et al. |
| 6,032,495 | A | | 3/2000 | Leu |
| 6,063,747 | A | | 5/2000 | Warwick |
| 6,147,577 | A | | 11/2000 | Cavey |
| 6,178,987 | B1 | | 1/2001 | Caruthers, Jr. et al. |
| 6,228,825 | B1 | * | 5/2001 | Gorlin et al. ..... 510/226 |

(Continued)

FOREIGN PATENT DOCUMENTS

| | | |
|---|---|---|
| GB | 2109398 | 6/1983 |

(Continued)

*Primary Examiner*—Douglas Mc Ginty
(74) *Attorney, Agent, or Firm*—Kirton & McConkie; Evan R. Witt

(57) ABSTRACT

A multiuse cleaning device in a solid state containing a homogeneous quantity of cleaning agent configured to dissolve and release a substantially consistent quantity of cleaning agent over a plurality of wash and rinse cycles. The cleaning agent includes a gas-releasing component and potassium silicate as a solubility control component to limit the solubility of the cleaning agent. The cleaning agent may include other ingredients such as an alkalinity agent as a pH regulator, a water softener to solvate metal ions in a solution of water, an optical brightener, an anti-redeposition agent, fragrances, surfactants, and other ingredients. Controlled dissolution of the cleaning agent composition releases a desired quantity of cleaning agent in each cleaning cycle over a plurality of cycles. A porous enclosure may be disposed around the solid cleaning agent.

29 Claims, 22 Drawing Sheets

U.S. PATENT DOCUMENTS

| | | | | |
|---|---|---|---|---|
| 6,262,004 | B1 * | 7/2001 | Caruthers, Jr. | 510/294 |
| 6,301,733 | B1 | 10/2001 | Dawson et al. | |
| 6,331,512 | B1 * | 12/2001 | Foote et al. | 510/226 |
| 6,362,150 | B1 | 3/2002 | Lunati | |
| 6,365,568 | B1 | 4/2002 | Olson et al. | |
| 6,387,864 | B1 | 5/2002 | Bartelme | |
| 6,403,551 | B1 * | 6/2002 | Caruthers, Jr. | 510/459 |
| 6,562,771 | B2 | 5/2003 | Finch et al. | |
| 6,689,276 | B2 | 2/2004 | Caruthers, Jr. | |
| 6,737,390 | B2 | 5/2004 | Sunder et al. | |
| 6,835,706 | B2 * | 12/2004 | Lentsch et al. | 510/446 |
| 7,053,040 | B2 * | 5/2006 | Caruthers, Jr. | 510/511 |
| 2002/0006891 | A1 * | 1/2002 | Scepanski | 510/447 |
| 2002/0132752 | A1 * | 9/2002 | Caruthers, Jr. | 510/447 |
| 2007/0184998 | A1 * | 8/2007 | Evans et al. | 510/302 |

FOREIGN PATENT DOCUMENTS

| | | |
|---|---|---|
| WO | 9117232 | 11/1991 |
| WO | 9804672 | 2/1998 |

* cited by examiner

MULTIUSE, SOLID CLEANING DEVICE AND COMPOSITION

CROSS-REFERENCED RELATED APPLICATIONS

This application is a continuation-in-part of U.S. patent application Ser. No. 10/597,837, which was the National Stage of International Application No. PCT/US2005/004133, filed Feb. 10, 2005, which is a continuation-in-part of U.S. patent application Ser. No. 10/775,264, filed Feb. 10, 2004 entitled "Autonomous Cleaning Composition And Method" and also a continuation-in-part of U.S. patent application Ser. No. 10/925,331, filed Aug. 24, 2004 entitled "Multiuse, Solid Cleaning Device And Composition." These prior applications are incorporated herein by reference.

BACKGROUND OF THE INVENTION

The present invention relates to a multiuse, solid cleaning composition. More specifically, the present invention is drawn to compositions for cleaning with water, including slow release compositions which provide consistent concentrations of cleaning agents delivered into water over multiple wash cycles.

Chemical cleaning agents, in one form or another, have long been used to remove dirt, oil, and particulate matter from a wide variety of articles. Cleaning improves the visual and tactile impression of an article, kills potentially harmful microbes, removes particles that interfere with breathing and vision, and may even extend the life of the article being cleaned. Things such as cookware, homes, automobiles, clothing, and the human body itself stand to benefit from the development of enhanced cleaning agents. Although the present invention contemplates cleaning systems useful for cleaning a wide variety of articles, it is particularly well-adapted for cleaning clothes, as in a washing machine, and dishes, as in a dish washer.

Soaps and detergents are two of the most common cleaning agents presently used. While they are often used interchangeably, the words "soap" and "detergent" actually denote different classes of compounds.

Soaps are made by a process of saponification wherein a fatty acid reacts with a base to yield the salt of the fatty acid, i.e., a soap. Soap probably has its origin in reacting animal fats, or lard, with alkaline salts, such as wood ash. Today, they are largely synthesized from animal fats and plant oils. Molecules of soap owe their cleaning capacity to their amphiphilic structure, which includes a hydrophobic portion consisting of a long hydrocarbon chain, and a hydrophilic portion composed of an ionic group at one end of the hydrocarbon chain. Because of the hydrocarbon chain, a molecule of soap is not truly soluble in water. Numerous molecules of soap will suspend in water as micelles, or clusters of molecules with long hydrocarbon chains in the inner portions of the cluster, and ionic, water soluble ends facing the polar water.

Because these micelles form hydrophobic centers, they are able to dissolve other non-polar substances, like oils. Once the non-polar, oily dirt is dissolved within the micelles of soap, the ionic surfaces of the micelle repel each other, suspending the oil droplets and preventing them from coalescing. In this fashion, dirt and oil become trapped within the water soluble micelles, and wash away with the water.

A primary disadvantage of soaps is that they form insoluble salts (precipitates) with ions found in hard water. These salts, usually formed when $Ca^{++}$ and $Mg^{++}$ ions react with the carboxylate ends of soap molecules, precipitate out of solution as bathtub rings, grits, and other deposits. Water softeners that exchange $Ca^{++}$ and $Mg^{++}$ ions for more soluble $Na^{+}$ ions can alleviate most of this problem.

Most laundry and dish washing products and many household cleansers actually contain detergents, not soaps. A detergent is a compound with a hydrophobic hydrocarbon chain plus a sulfonate or sulfate ionic end (whereas soaps have carboxylic ends). Because detergents also have an amphiphilic structure, they also form micelles and clean in the same fashion as soaps. However, detergents have the advantage that most metal alkylsulfonates and sulfates are water-soluble. Therefore, detergents do not precipitate out of solution with metal ions found in water. As a result, detergents are not inhibited by hard water. In addition, detergents can be synthesized with continuous chain alkyl groups, which are more easily broken down, or biodegraded, into smaller organic molecules by the microorganisms in septic tanks and sewage treatment plants.

A drawback of most detergents is that they contain additives that take much longer to biodegrade. Some components containing phosphates must be treated in plants. Phosphates promote algae growth, chocking bodies of water and streams. Another disadvantage of detergents is that they can leave behind an undesirable residue even after thorough rinsing.

Detergents are currently used in many household appliances, such as dishwashers and washing machines. Presently, a user must measure out a dose of detergent to add to the cleaning appliance before every cleaning cycle. Conventional packaging and use of detergents creates messy clutter, consumes time, and typically results in a waste of detergent from overdosing. In addition, most washing machines for clothing use a separate rinsing cycle in order to remove the residue. Thus, additional time, water, and heat energy are required to complete the washing process.

It would be a great advancement in the art to provide a novel cleaning system that uses a novel non-detergent composition of cleaner that leaves no residue and therefore, requires no rinsing cycle. Another improvement in the art would be to provide a cleaning agent that is biodegradable. Still another improvement would be if this cleaning agent were made from natural materials. It would also be a great advancement in the art to provide a new method for making a non-detergent cleaning agent. It would be another advancement in the art to provide a cleaning agent that cleans as good as or better than the detergents presently on the market.

Furthermore, it would be an improvement in the art to simplify the cleaning process and ameliorate the resultant mess with improved, preferably measurement-free or automatic, dosing over many cleaning cycles.

BRIEF SUMMARY OF THE INVENTION

In accordance with the invention as embodied and broadly described herein, a multiuse, solid cleaning device and cleaning method are disclosed in suitable detail to enable one of ordinary skill in the art to make and use the invention.

The multiuse cleaning device contains a homogeneous quantity of cleaning agent in solid form configured to slowly dissolve and release a substantially consistent quantity of cleaning agent over a plurality of wash and rinse cycles. The device may be used in various cleaning applications such as laundry and dish washing applications.

The cleaning agent includes as core ingredients a gas-releasing component and a solubility control component to limit the solubility of the cleaning agent. Additional ingredients may also be included such as an alkalinity agent as a pH regulator, a water softener to solvate metal ions in a solution of water, and an optical brightener for increased color clarity and brightness. Gas-releasing component clean by reacting with acids (soils) and by mechanical microscrubbing as they yield gases, such as carbon dioxide. The gas-releasing component is preferably selected from perborates, percarbonates, and mixtures thereof. Sodium perborate monohydrate, sodium percarbonate, and mixtures thereof are presently preferred gas-releasing agents.

The solubility control agent is a material resistant to dissolving in water, i.e., water insoluble or slightly water-soluble. It controls solubility by dissolving only an equilibrium concentration of composition in solution. The amount of solubility control component in the composition determines the equilibrium concentration of the composition in a solution, e.g., water. Therefore, the amount of solubility control component should be sufficient to yield a predetermined equilibrium concentration of the cleaning agent. Similarly, the amount of cleaning agent should be sufficient to provide a predetermined amount of gas in solution. The amount of alkalinity agent should be sufficient to provide a predetermined pH in solution. The amount of water softener should be sufficient to soften household water in solution.

U.S. Pat. Nos. 6,178,987, 6,262,004, and 6,403,551 disclose a solid cleaning composition containing amorphous silica as the solubility control agent. Amorphous silica ($H_2SiO_3$) is a preferred solubility control agent because it occurs in nature and is completely biodegradable. In the cleaning compositions containing amorphous silica disclosed in the above-identified patents, careful heating and pressurizing are needed to prepare the cleaning compositions. It has been found that commercially available potassium silicate ($K_2O.nSiO_2.mH_2O$), in liquid form, may be used to prepare the cleaning agent compositions at room temperature without special heating or pressure. Other silicates, such as sodium silicate, tend to dissolve quickly and may not provide desired solubility control. However, in some cases sodium silicate may be usable within the scope of the present invention. The other ingredients may be used at approximately the same concentration reported in the foregoing patents. Completion of the process may include casting or molding the composition in a shape selected to control surface area, and curing the composition. The composition cures independently at room temperature as water becomes depleted through evaporation and/or as a result of the anhydrous compounds absorbing water.

One provider of potassium silicate in liquid form is PQ Corporation, Valley Forge, Pa. under the brand name KASIL®. This liquid potassium silicate contains about 71% water and about 29% potassium silicate. It is possible to purchase potassium silicate in solid hydrated and anhydrous forms, but it is presently preferred to convert the solid potassium silicate into the liquid form by adding water before it is used in the present invention. Unless specifically noted, the potassium silicate used in the cleaning agent composition formulations disclosed herein is liquid potassium silicate.

The water softener is preferably a naturally occurring and biodegradable material capable of solvating hard water ions, such as a zeolite. Naturally occurring zeolites are presently preferred; however, the invention may be used with synthetic zeolites which function in a manner equivalent to natural zeolites and which biodegrade. The water softener solvates hard ions and inhibits them from reacting with other components to form insoluble salts.

The cleaning agent preferably includes an optical brightener present in an amount from about 0.5 to 8% by weight, more preferably from about 0.5 to 5% by weight, and optimally from about 0.5 to 3% by weight. The cleaning agent may optionally include a fragrance component present in an amount from about 0.5 to 12% by weight, more preferably from about 1 to 12% by weight, and optimally from about 1 to 5% by weight. The cleaning agent may optionally include an anti-redeposition component present in an amount from about 0.5 to 10% by weight, more preferably from about 0.5 to 5% by weight, and optimally, from about 0.5 to 3% by weight.

The alkalinity agent is present in an amount sufficient to give a solution of the composition a pH greater than 7, and preferably a pH from about 7 to about 10.5, more preferably from 7.8 to about 8.8. Examples of alkalinity agents include, but are not limited to, an alkali hydroxide, alkali hydride, alkali oxide, alkali sesquicarbonate, alkali carbonate, alkali phosphate, alkali borate, alkali salt of mineral acid, alkali amine, alkaloid, alkali cyamide, and mixtures thereof. Sodium hydroxide is one presently preferred alkalinity agent.

In certain embodiments within the scope of the present invention, the method of preparing the solid cleaning agent may include providing a solvent, such as water; providing a gas-releasing agent, such as sodium bicarbonate, sodium percarbonate, sodium perborate monohydrate, sodium perborate tetrahydrate, and mixtures thereof; providing a solubility control agent, such as potassium silicate; and providing other optional ingredients such as a water softener, such as a zeolite; mixing the ingredients; pouring the mixture into a curing vessel; and allowing the composition to cure to a solid form.

A porous enclosure may be disposed around the solid cleaning agent to hold it during use. The porous enclosure may vary in configuration depending upon the application of the solid cleaning agent. For example, a porous enclosure designed for use in laundry cleaning applications may have a different configuration from a porous enclosure designed for use in dish washing applications. The porous enclosure may optionally be elastic and conform to the size of the solid cleaning agent as the cleaning agent shrinks in size due to dissolution of cleaning agent. Alternatively, the porous enclosure may be rigid and retain its shape. In laundry cleaning applications, the enclosure helps reduce or eliminate direct transfer of cleaning agent residue onto fabric surfaces after a final rinse cycle when the cleaning device and fabric surfaces are in contact for an extended time period. The porous enclosure may be a polymeric rubber-like material, an elastic net-like material or a woven fabric material. It may be a porous fabric bag with a covering of ruffle-like material.

The porous enclosure that houses or surrounds the cleaning agent may also provide other useful functions in conjunction with the present invention. The enclosure may be configured to retain fragrance with the cleaning agent, to regulate sudsing (lathering) during operation of the cleaning appliance, to create drag in the water to quiet any contact with the cleaning agent and the cleaning appliance, and/or to create a barrier between the cleaning agent and the articles being cleaned, such as clothes or dishes.

In one embodiment, the porous enclosure is fabricated of a polymeric rubber-like material having a plurality of holes or openings to allow water to flow into and out of the enclosure. The holes may be spaced or staggered such that contact between the porous enclosure the cleaning appliance produces a pump-like activity which draws water into the enclosure and forces water out of the enclosure during use. The porous enclosure preferably includes a plurality of ribs which are sufficiently elastic to cushion and protect the solid cleaning agent from jarring movement and also to protect the interior of the cleaning appliance wash chamber. The ribs are preferably oriented in relation with the holes to provide effective drainage of water from the interior of the enclosure upon completion of a wash cycle. The ribs may be crisscrossed.

It is presently preferred to use an elastic, porous liner in combination with the porous enclosure. The liner helps moderate dissolution of the cleaning agent. It also prevents direct contact between the cleaning agent and clothing. Being elastic, the liner preferably shrinks in size as the cleaning agent dissolves. In one embodiment, the liner is made of a single layer of elastic material, such as woven nylon.

In some embodiments, the enclosure is a multilayered structure. In some embodiments, the enclosure is made of three layers: an outer layer, a middle layer, and an inner layer. The outer and inner layers may be both made of a porous material through which water may pass. In some embodiments, this porous material is a mesh material that is smooth and non-abrasive. The middle layer may be constructed to provide spacing and/or padding between the outer layer and the inner layer. In some embodiments, the middle layer is made of a material such as ruffled netting and porous foam.

In dishwasher applications, the porous enclosure may function as a dispenser of the cleaning agent. Prior U.S. Pat. Nos. 6,178,987, 6,262,004, and 6,403,551 disclose an autonomous cleaning apparatus and method utilizing a dispenser. The exact configuration of the dispenser apparatus may be varied, but it should hold the solid cleaning composition, allow a portion of the wash water to contact the cleaning composition, and then drain the treated water into the dishwasher. The dispenser may include an internal baffling system to reduce direct water-flow into the dispenser but still allow for water-flow around the bottom/exposed portion of the solid cleaning agent to carry away dissolution. The dispenser may optionally provide air spacing in its outer structure to inhibit any over-heating and melting of the cleaning agent. The dispenser apparatus is preferably constructed of an inert plastic material that can be disposed within or attached to the interior of the dishwashing machine. For convenience, it may be placed on either the top or bottom rack within the dishwasher according to the user's preference.

The cleaning device may include an indicator structure disposed within the quantity of cleaning agent to signal when to replace the cleaning device. It may optionally include an internal skeleton within the quantity of cleaning agent to provide structural strength to the cleaning device.

The cleaning device may be spherical, aspherical, oval, oblate, rounded, cylindrical, rectangular, or irregular shaped. When used in laundry applications, the cleaning device is preferably in the form of a ball. When used in dish washing applications, a cylindrical shape for the cleaning device may be preferred, although other shapes may be used. The size of the cleaning device may vary depending upon the concentration of the cleaning agent and its dissolution rate and the desired quantity of cleaning agent to be released in each wash or rinse cycle. For example, a more concentrated cleaning agent, with a slower dissolution rate, may have a smaller size than a device having a lower concentration cleaning agent with a higher dissolution rate. For convenience, the cleaning device may have a diameter in the range from about 2 to about 6 inches in residential laundry cleaning applications and 4 to 12 inches in commercial/industrial applications. A device having a size approximately the same as a softball may be used. The cleaning device used in dish cleaning application may have a different size and configuration. For example, cleaning device may be a cylinder from about 4 to 6 inches tall having a diameter from about 2 to 4 inches.

The cleaning agent in solid form dissolves and releases a substantially consistent quantity of cleaning agent over from about 5 to 50 (or more) wash or rinse cycles. In other embodiments, the cleaning agent in solid form dissolves and releases a substantially consistent quantity of cleaning agent over from about 10 to 40 wash or rinse cycles. As would be expected, the choice to use hot, warm, or cold water in the wash/rinse cycle will affect the dissolution of the cleaning agent—i.e., the cleaning agent will more readily dissolve in hot water than in cold water. Thus, the exact number of wash/rinse cycles that the cleaning agent will be operable will depend in part on the temperature of the water in the cleaning machine.

Similarly, the weight of the solid cleaning agent will affect the number of wash or rinse cycles. For example, a 600 gram device is expected to provide more cleaning cycles then a 300 gram device.

As noted above, the cleaning agent is designated such that a substantially consistent quantity of cleaning agent will dissolve during each cleaning cycle. "Substantially consistent quantity" means that the amount of cleaning agent that dissolves per wash cycle generally will fall within a predictable range. For example, the range may be defined as follows:

$$\overline{X}_{10} \pm \text{about } 50\%$$

where $\overline{X}_{10}$ is the average amount of cleaning agent that dissolves during the first 10 wash cycles and "50%" means 50% of the $\overline{X}_{10}$ value. However, embodiments in which the amount of cleaning agent 10 that dissolves per wash cycle may range as high as $\overline{X}_{10}$±about 65%. Some of the presently preferred embodiments will be designed such that the amount of cleaning agent 10 that dissolves per wash cycle is within the range $\overline{X}_{10}$±about 40% and even $\overline{X}_{10}$±about 25%.

In one embodiment of the cleaning agent within the scope of the present invention, the gas-releasing component is present in an amount from about 35% to 60% by weight and the solubility control component is present in an amount from about 30% to 60% by weight. In another embodiment of the cleaning agent within the scope of the present invention, the gas-releasing component is present in an amount from about 40% to 55% by weight, the solubility control component is present in an amount from about 35% to 50% by weight, the water softener is present in an amount from about 1% to 10% by weight, the alkalinity agent is present in an amount from about 1% to 12% by weight, and the optical brightener is present in an amount from about 0.5% to 5% by weight.

In a preferred embodiment within the scope of the present invention, the gas-releasing component is sodium perborate monohydrate present in an amount from 42% to 52% by weight, the solubility control component is potassium silicate present in an amount from 35% to 45% by weight, the water softener is a zeolite present in an amount from 1% to 5% by weight, the alkalinity agent is sodium hydroxide present in an amount from 1% to 5% by weight, and the optical brightener is present in an amount from about 0.5% to 3% by weight.

A method of providing a cleaning agent to a cleaning appliance is disclosed. The cleaning appliance may be a laundry machine or a dishwashing machine. The method includes the step of obtaining a multiuse cleaning device in a solid state containing a homogeneous quantity of cleaning agent in solid form configured to dissolve and release a substantially consistent quantity of cleaning agent over a plurality of cleaning wash and rinse cycles. As mentioned above, the cleaning device may have a porous covering or enclosure disposed around the solid cleaning agent. The porous enclosure may be elastic and conform to the size of the solid cleaning agent as the cleaning agent shrinks in size due to dissolution of cleaning agent. The porous covering or enclosure may be pliable and may not necessarily conform to the size of the solid cleaning agent. The porous enclosure may be a rigid plastic enclosure and optionally insulated. The method further includes the step of depositing the cleaning device within the cleaning appliance under conditions such that the cleaning device is exposed to water from the plurality of cleaning wash and rinse cycles.

These and other features, and advantages of the present invention will become more fully apparent from the following description and appended claims, or may be learned by the practice of the invention as set forth hereinafter.

DETAILED DESCRIPTION OF THE INVENTION

Figure 1:
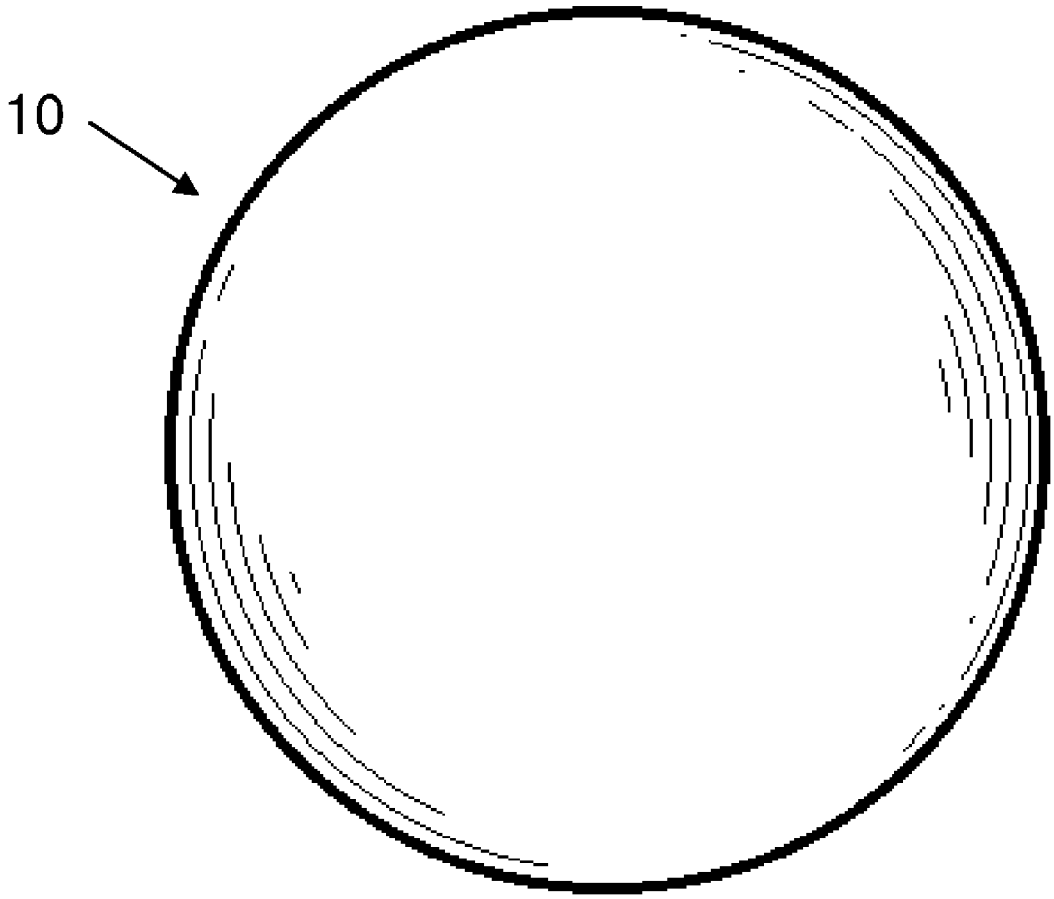
FIG. 1 shows a multiuse cleaning device within the scope of the present invention.

The present invention is drawn to a multiuse cleaning device containing a homogeneous quantity of cleaning agent in solid form and to methods of manufacture and use. The cleaning agent in solid form preferably provides controlled dissolution in contact with water such that a sufficient quantity of cleaning agent is dissolved and released for use in multiple wash cycles of a cleaning appliance.

The cleaning agent composition may include a gas-releasing agent that is water soluble and a solubility control agent that is only slightly water soluble. The gas-releasing agent provides cleaning action. However, if the gas-releasing agent is permitted to freely dissolve, the resulting cleaning solution will have an unknown or uncontrolled concentration of gas-releasing agent. Thus, it is desirable to add a solubility control agent to the cleaning agent to control its equilibrium concentration, and hence, the concentration of gas-releasing agent in the cleaning solution.

The cleaning agent may be further enhanced through the addition of an alkalinity agent, a water softener, and other ingredients. The alkalinity agent controls the pH of the cleaning agent, and therefore the pH of the resultant cleaning solution. The pH of the cleaning solution preferably remains within a certain range because the pH controls the rate at which the gas-releasing agent reacts. The gas-releasing agent or the solubility control agent may be configured to control the pH of the cleaning solution, but a separate alkalinity agent is presently preferred. The softener prevents the formation of a residue on the items to be cleaned by solvating hard water ions. The gas-releasing agent, the solubility control agent, or the alkalinity agent may be configured to solvate hard water ions, but a separate softener is preferable.

The gas-releasing agent should not release gas in the solid state cleaning agent, but it should be able to release gas in a cleaning solution of the cleaning agent at ambient temperature. The gas-releasing agent need not react with other agents, but may simply decompose at ambient temperature to release gas. Those gas-releasing compounds that are natural and biodegradable are preferred. In some embodiments, the gas-releasing agent is a percarbonate or perborate. For example, sodium percarbonate, which is also known as sodium carbonate peroxyhydrate, ($2Na_2CO_3.3H_2O_2$), sodium perborate monohydrate ($NaBO_3.H_2O$), and sodium perborate tetrahydrate ($NaBO_3.4H_2O$) are effective, low cost gas-releasing agents. Mixtures of gas releasing agents may be used. However, numerous other gas-releasing agents are known to those skilled in the art, and may be suitable for use with the present invention provided they react with potassium silicate to form a solid matrix. Sodium perborate monohydrate is a presently preferred gas releasing agent.

The solubility control agent should be either water insoluble or only slightly water soluble. Numerous compounds may serve this function, including but not limited to hydrophobic compounds. Those solubility control agents that are both found in nature and biodegradable are preferred. Potassium silicate is presently preferred because it may be used to prepare the solid cleaning agent composition at room temperature.

The alkalinity agent may be selected from, but is not limited to, a group consisting of alkali hydroxide, alkali hydride, alkali oxide, alkali carbonate, alkali bicarbonate, alkali phosphate, alkali borate, alkali salt of mineral acid, alkali amine, alkaloid, alkali cyamide, alkali metal, and alkali earth metal. Sodium hydroxide is an example of one presently preferred alkalinity agent. Other alkalinity agents that tend to increase the pH of a neutral solution are familiar to those in the art, and are within the scope of the present invention. Those alkalinity agents that are both found in nature and biodegradable are preferred. Sodium carbonate provides the dual function of an alkalinity agent and a gas releasing agent. Potassium silicate may provide the dual function of an alkalinity agent and a solubility control agent. Similarly, sodium percarbonate provides alkalinity control in addition to its gas release function. In addition to being an alkalinity agent, sodium hydroxide may provide the dual function of being a processing aid that facilitates the formation of a potassium silicate slurry and/or provides catalytic action for solidification of the cleaning agent.

The softener should preferably be selected to exchange soluble sodium or other ions for the insoluble calcium and magnesium ions. Those softeners that are both found in nature and biodegradable are preferred. A cleaning agent composition wherein the softener is natural zeolite ($Na_2O.Al_2O_3.(SiO_2)_x.(H_2O)_x$) is presently preferred because it occurs in nature and is completely biodegradable. Synthetic zeolites may be used provided that they perform the desired softening function and are biodegradable.

The amount of gas-releasing agent in the cleaning agent determines how much gas is released in a cleaning solution of the cleaning agent formed when the cleaning agent dissolves in a solvent, e.g., water. Therefore, the gas-releasing agent in the cleaning agent should comprise an amount sufficient to release a predetermined amount of gas in a cleaning solution of the cleaning agent. A concentration of gas-releasing agent from 35% to 60% by weight of the cleaning agent may be used. In one embodiment, the concentration of gas-releasing agent is from 40% to 55% by weight. In another embodiment, the concentration of gas-releasing agent is from 42% to 52% by weight of the cleaning agent.

The amount of solubility control agent in the cleaning agent determines the equilibrium concentration of the cleaning agent in the cleaning solution. Therefore, the amount of solubility control agent in the cleaning agent should be selected to yield a predetermined equilibrium concentration of cleaning agent in the cleaning solution. A concentration of solubility control agent from 30% to 60% by weight of the cleaning agent may be used. In one embodiment, the concentration of the solubility control agent is about 35% to 50% by weight of the cleaning agent. In another embodiment, the concentration of solubility control agent is about 35% to 45% by weight of the cleaning agent.

The amount of alkalinity agent in the cleaning agent affects the pH of the cleaning solution. Therefore, the cleaning agent should include an amount of alkalinity agent selected to provide a cleaning solution within a predetermined pH range. A concentration of alkalinity agent from 0.5% to 20% by weight of the cleaning agent may be used, with a concentration from 1% to 12% by weight being more preferred. Because the alkalinity agent may also provide gas releasing functionality, in the case of sodium carbonate, the actual concentration of the gas releasing agent and alkalinity agent may be outside the foregoing concentration range. In one embodiment, the concentration of alkalinity agent is about 1% to 5% by weight, providing a cleaning solution with a pH of about 8.8 after dilution inside the cleaning appliance.

The softener in the cleaning agent softens the cleaning solution by scavenging residue-forming ions. Therefore, the softener should comprise an amount of cleaning agent sufficient to soften household water. A concentration of softener from 0.5% to 20% by weight of the cleaning agent may be used, with a concentration from 1% to 10% being more preferred. In one embodiment, the concentration of the softener is about 1% to 5% by weight.

The optical brightener is an additive that improves visual appearance in cleaned fabrics. Optical brighteners are known to persons having ordinary skill in the art. An optical brightener may be added to the cleaning agent in an amount from about 0.5% to 8% by weight, and more preferably from about 0.5% to 5% by weight. In one embodiment, the concentration of optical brightener is about 0.5% to 3% by weight. One currently preferred optical brightener is sold under the tradename Tinopal by Ciba Specialty Chemicals, Inc. of Basel, Switzerland.

Water molecules may form complexes with these components and could be bound up within the cleaning agent by virtue of the process of making the cleaning agent. Water may be added to the ingredients of the cleaning agent during manufacturing to aid in processing. Water may comprise from 1% to 20% of the cleaning agent by weight. Preferably, water comprises approximately 5 to 10% by weight of the cleaning agent. It will be appreciated that some components of the cleaning agent may contain water, such as potassium silicate, sodium perborate monohydrate, sodium hydroxide, zeolite, and other ingredients, which may limit the amount of extra water that needs to be mixed with the dry ingredients.

The solid cleaning agent within the scope of the present invention comprises a solid matrix formed from the reaction of the gas releasing agent and the solubility control agent. Additional ingredients are incorporated within the solid matrix to form the cleaning agent in a solid stable state. The additional ingredients may vary depending upon the application. For example, for laundry applications, a porous surface surfactant may be used. In contrast, for dish washing applications, a solid surface surfactant may be used. Similarly, in dish washing applications, borax may be included to improve the solid surface cleaning efficacy.

In operation, items to be cleaned are exposed to the cleaning solution, which causes a number of processes to occur. The basic cleaning solution attacks the acids in dirt and oil. The gas-releasing agent releases gas that reacts with dirt and oil. In a cleaning appliance for washing clothing, dirt and oil would be dislodged from clothing in a removal step due to reaction with the released gas. In a cleaning appliance for washing dishes, food material, including fats and oils, are dislodged and removed from the dishes due to reaction with the released gas and solid surface surfactants.

Simultaneously, in a scavenging step, the softener, if present, scavenges ions to prevent the buildup of residue on the articles to be cleaned. In addition, the alkalinity agent keeps the pH of the cleaning solution slightly basic. This serves two functions. First of all, it limits the reaction of the gas-releasing agent so that the gas evolves at a controlled rate and the cleaning solution has time to become thoroughly intermixed with the articles to be cleaned. Second, the basic cleaning solution reacts to neutralize acids in the soils.

Sodium perborate (monohydrate or tetrahydrate) is one presently preferred gas-releasing agent in the cleaning agent of the present invention. It undergoes hydrolysis in contact with water to produce hydrogen peroxide and borate. It serves as a source of active oxygen for use in cleaning and bleaching. Sodium perborate is a less aggressive bleach than sodium hypochlorite, causing less degradation to dyes and textiles or harm to tableware such as glazed ceramics, glass, plastics and metals. Borates also have some useful non-oxidative bleaching properties. Advantageously, the byproducts of the cleaning process appear in nature, so there is no need for the extensive treatment of phosphates and other non-biodegradable materials, as required by presently available detergents.

The softener, which may be natural or synthetic zeolite, exchanges sodium ions ($Na^+$) for magnesium ($Mg^{++}$) and calcium ($Ca^{++}$) ions: $Mg^{++}+Ca^{++}+\text{zeolite}\rightarrow\text{zeolite}+4Na^+$. Sodium ions and sodium salts are readily water soluble and will not form precipitates. Without the softener, the $Mg^{++}$ and $Ca^{++}$ could react to form insoluble salts, precipitating out of solution and leaving a hard film behind.

One possible method for making the cleaning agent in a solid state will be described. In the described method a gas releasing agent and a solubility control agent are combined to form the solid matrix of the cleaning agent. It will be appreciated that the cleaning agent may be manufactured with additional ingredients, including but not limited to, an alkalinity agent, a softener, an optical brightener, an anti-redeposition agent, a fragrance, a surfactant, with some components performing multiple functions or with additional, unnamed agents.

Referring to FIG. 1, a multiuse cleaning device 10 is illustrated. The cleaning device 10 is shown in the form of a spherical ball. The ball does not need to be spherical, but it can take any practical, easily manufactured shape such as aspherical, oval, oblate, rounded, cylindrical, rectangular, or other irregular shaped configuration.

Figure 2:
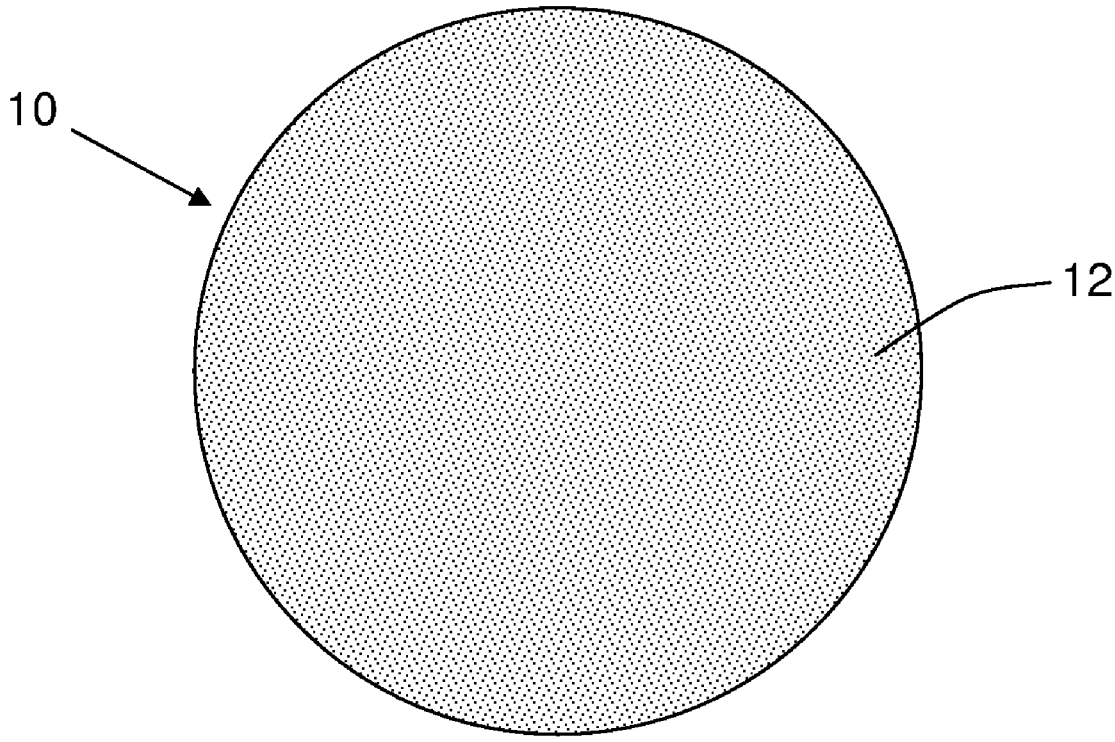
FIG. 2 shows a cross-sectional view of a multiuse cleaning device.

As shown in FIG. 2, the multiuse cleaning device 10 contains a homogeneous quantity of cleaning agent 12 in solid form. The cleaning agent 12 has a composition as described herein. In the embodiment shown in FIG. 2, the cleaning device 10 is a solid mass of cleaning agent. The cleaning device is deposited within the cleaning appliance under conditions such that the cleaning device is exposed to water from the plurality of cleaning wash and rinse cycles. Under typical conditions, the cleaning device is deposited within the cleaning appliance together with the soiled articles, such as clothing, towels, linens, and similar articles (hereinafter referred to as "laundry articles"), to be laundered or such as dirty dishes, glasses, cooking and eating utensils (hereinafter referred to as "dish articles") to be washed. Water from wash and rinse cycles dissolves a portion of the cleaning device and releases a controlled quantity of cleaning agent which is able to clean the soiled articles as described herein. Upon completion of the cleaning cycle, the clean articles are removed, but the cleaning device may remain within the cleaning appliance for use in multiple cleaning cycles.

Figure 3:
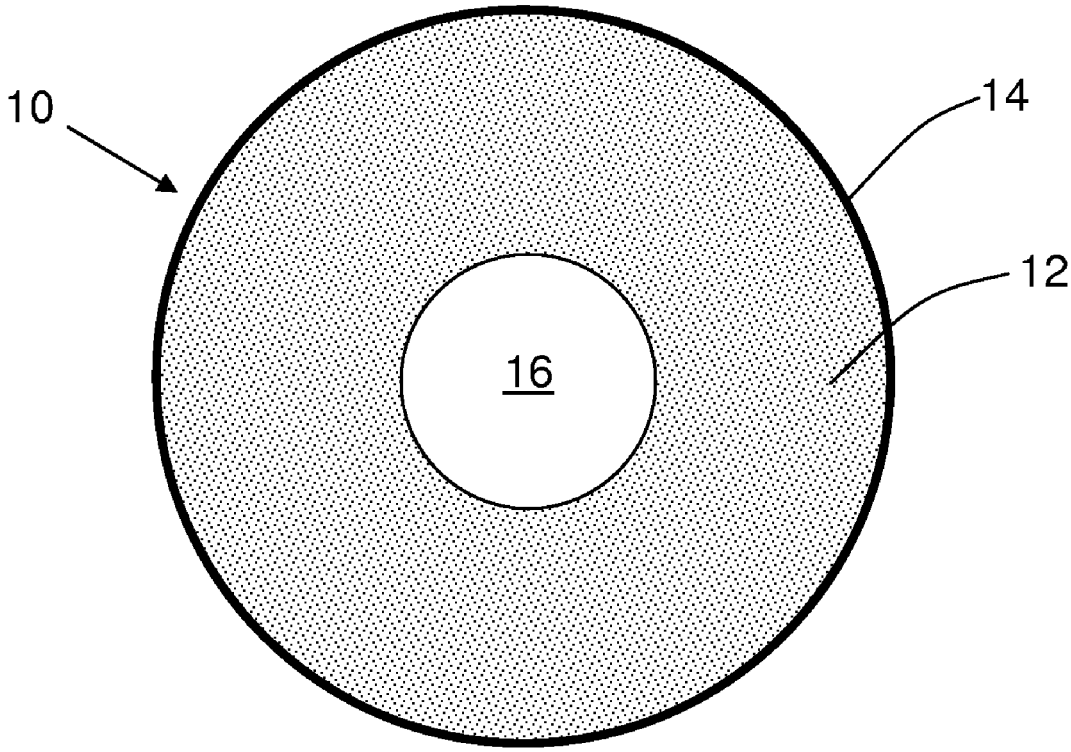
FIG. 3 shows a cross-sectional view of another multiuse cleaning device.

Referring to FIG. 3, the cleaning device 10 may have an indicator structure 16 which indicates when it is time to replace a used cleaning device with a fresh cleaning device 10. The structure 16 may take a variety of different forms. For example, it may spherical, disk, rod, spiked, or irregular shaped. The important feature is that the structure be able to indicate, such as by a visible sign, that the cleaning device 10 should be replaced. The cleaning device 12 may include a support structure or internal skeleton disposed within the quantity of cleaning agent 12 to provide structural strength to the cleaning device.

Also shown in FIG. 3 is a porous enclosure 14 disposed around the solid cleaning agent 12. The porous enclosure 14 may be elastic and conform to the size of the solid cleaning agent 12 as the cleaning agent shrinks in size due to dissolution of cleaning agent 12. The porous enclosure 14 may be pliable or flexible and not necessarily conform tightly to the cleaning agent as it dissolves and shrinks in size.

The enclosure 14 helps reduce or eliminate direct transfer of cleaning agent residue onto the surface of cleaned articles after a final rinse cycle when the cleaning device and cleaned articles are in contact for an extended time period. For example in the case of laundry articles, users do not always remove laundry articles from the laundry cleaning machine as soon as the wash cycle is completed. Under such circumstances, the cleaning device 10 would contact moist fabric surfaces for a period of time. This may result in transfer of cleaning agent onto fabric surfaces. The porous enclosure 14 provides a barrier which separates the cleaning agent 12 from the fabric surfaces.

Figure 4:
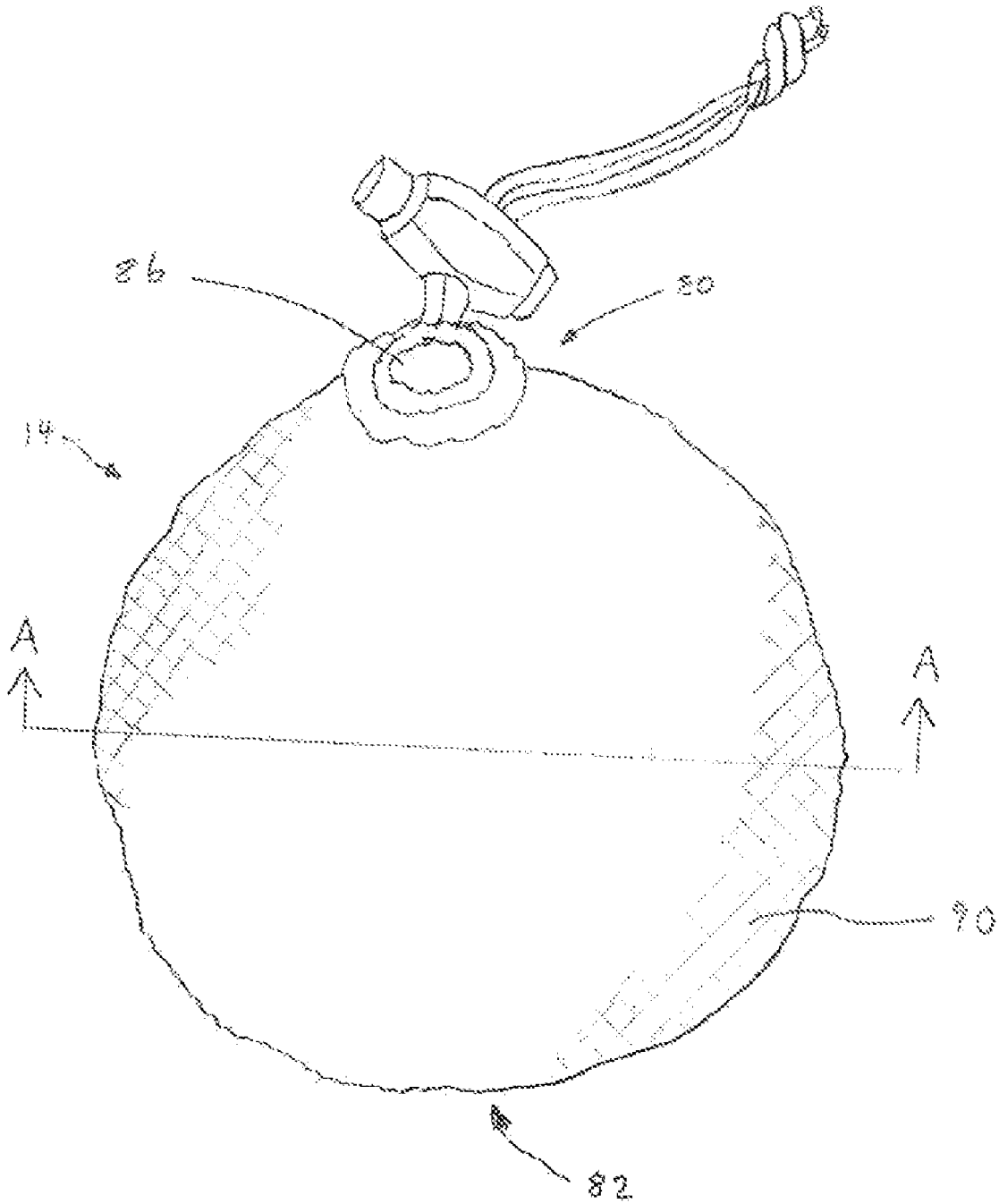
FIG. 4 shows a perspective view of a porous enclosure that houses the multiuse cleaning device.

Referring now to FIG. 4, an embodiment of the enclosure 14 is illustrated in greater detail. As explained in greater detail above, the enclosure 14 is designed such that it may surround and/or house the cleaning agent 10. In general, the enclosure 14 has a top end 80 and a bottom end 82. The bottom end is 82 sealed through sewing, stitching, Velcro, elastic, bonding, or other similar methods. The top end 80 comprises a closeable top 86 such that the enclosure 14 may surround and house the agent 10. In some embodiments, the closeable top 86 is a drawstring. However, Velcro, elastic, or other items/methods capable of forming a closeable top may also be used.

FIG. 4 also shows a graphical illustration of pores or openings 90 that may be part of the material used to make the enclosure 14. Such pores 90 are added to all or a portion of the enclosure 14 and are designed to allow water to pass through the enclosure 14 but to retain the solid cleaning agent 10. As noted above, the pores 90 may be formed by using a woven fabric material, a net-like material, or other materials. In one presently preferred embodiment, the enclosure 14 is made from material of the type used to make athletic jerseys, such as football jerseys. This material not only has adequate porosity to freely allow the passage of water, but also this type of material is non-abrasive to the other laundry articles in the washing machine.

Figure 5:
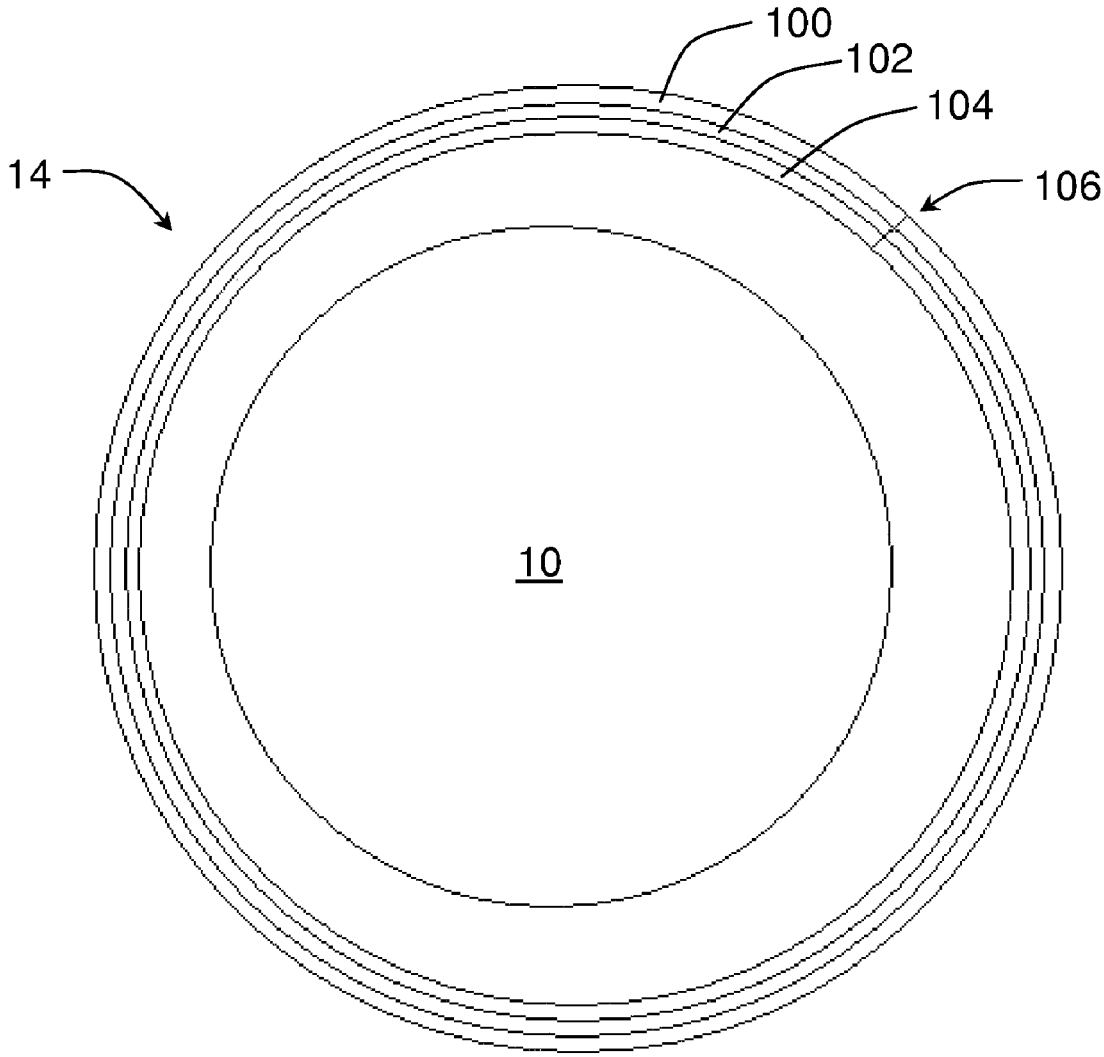
FIG. 5 is a cross-sectional view taken along the line A-A of FIG. 4.
Figure 6A:
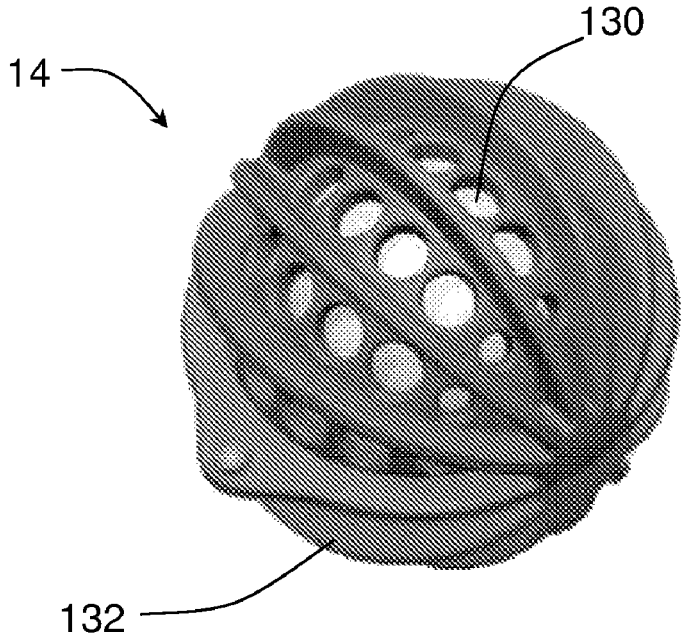
FIG. 6A is a perspective view of another porous enclosure that houses the multiuse cleaning device.
Figure 6B:
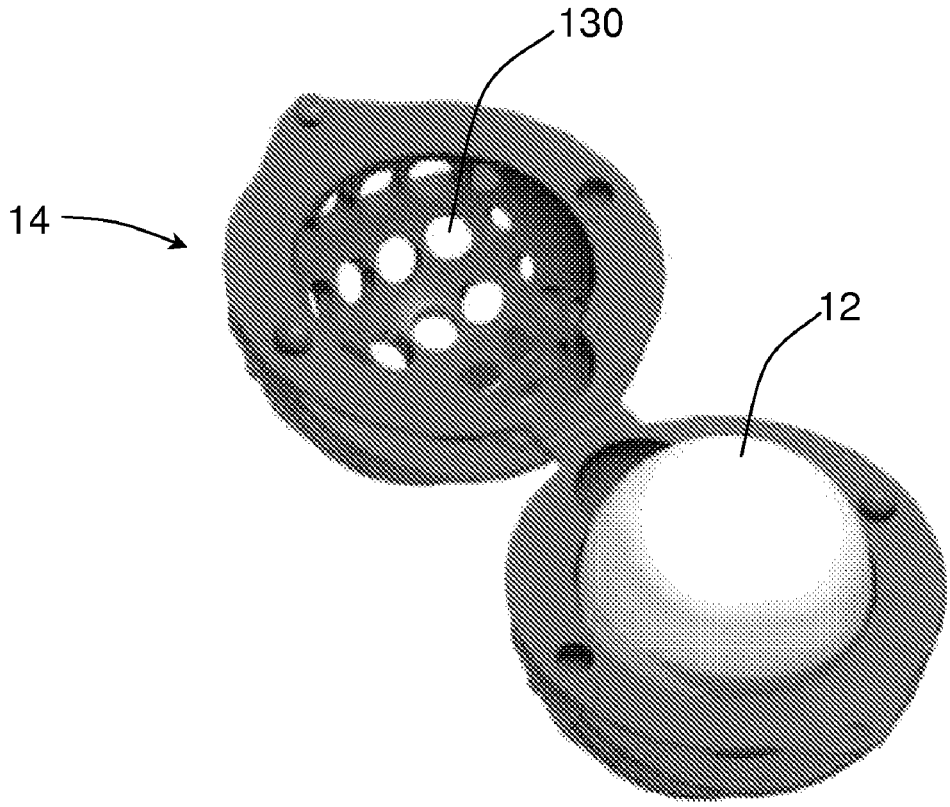
FIG. 6B is a perspective view of the porous enclosure of FIG. 6A shown in an open configuration.
Figure 7:
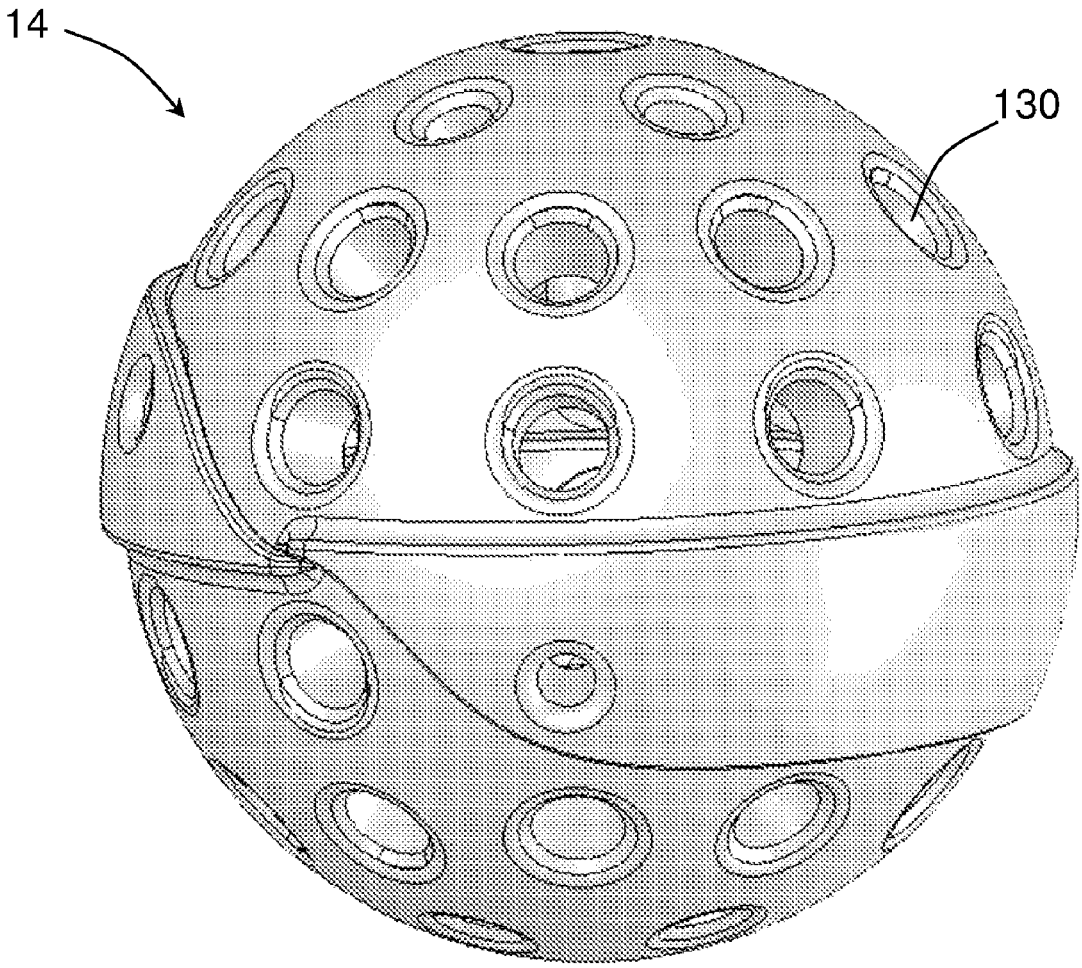
FIG. 7 is a perspective view of yet another porous enclosure that houses the multiuse cleaning device.

FIG. 5 is a cross-sectional view taken along the line A-A of FIG. 4 and illustrates the construction of the enclosure 14. The enclosure 14 may comprise multiple layers of material. In general, these multiple layers of material are used so that when the enclosure 14 surrounds the agent 10, there is about ½ inch of material between the agent 10 and the laundry articles in the washing machine. In the embodiment shown in FIG. 5, three distinct layers of material have been used. Other embodiments may also be made using more or less than three layers, as desired.

In FIG. 5, the porous enclosure 14 includes an outer layer 100, a middle layer 102, and an inner layer 104 which have been connected together via stitching 106. Of course, other methods of connecting the layers together such as bonding with adhesive or heat, weaving, etc. may also be used. In some embodiments, it may be important to select materials for the layers 100, 102, 104 that (1) allow the water freely pass in and out of the bag 14 and (2) will not retain more than negligible amounts of water.

The outer layer 100 and the inner layer 104 may be both made of a porous material, such as a mesh material. However, the outer layer 100 and the inner layer 104 need not be made of the same material. They may be made of different materials. The outer layer 100 is preferably smooth and non-abrasive to the clothing or other laundry articles. The inner layer 104 may be smooth and non-abrasive to the cleaning device to minimize unwanted mechanical abrasion of the cleaning agent.

The middle layer 102 is made of a padding material to provide spacing and/or structure between the outer layer 100 and the inner 104. The middle layer may be constructed of materials such as ruffled netting, porous foam, or other similar materials.

As shown in FIGS. 6A, 6B, 7, and 8, the porous enclosure 14 may be fabricated of a rubber-like material with a plurality of holes 130 or openings to allow water to flow into and out of the enclosure 14. The holes 130 may be spaced or staggered to provide a pump-like activity which draws water into the enclosure and forces water out of the enclosure during use. The porous enclosure preferably includes a plurality of ribs 132 which are sufficiently elastic to cushion and protect the solid cleaning agent from jarring movement and also to protect the interior of the wash chamber. The ribs 132 are preferably oriented in relation with the holes 132 to provide effective drainage of water from the interior of the enclosure upon completion of a wash cycle. The ribs may be criss-crossed. In a preferred embodiment, the ribs cross each other at holes to disperse water flowing through the holes and to facilitate water drainage out of the device 10 when it is no longer moving.

Figure 8:
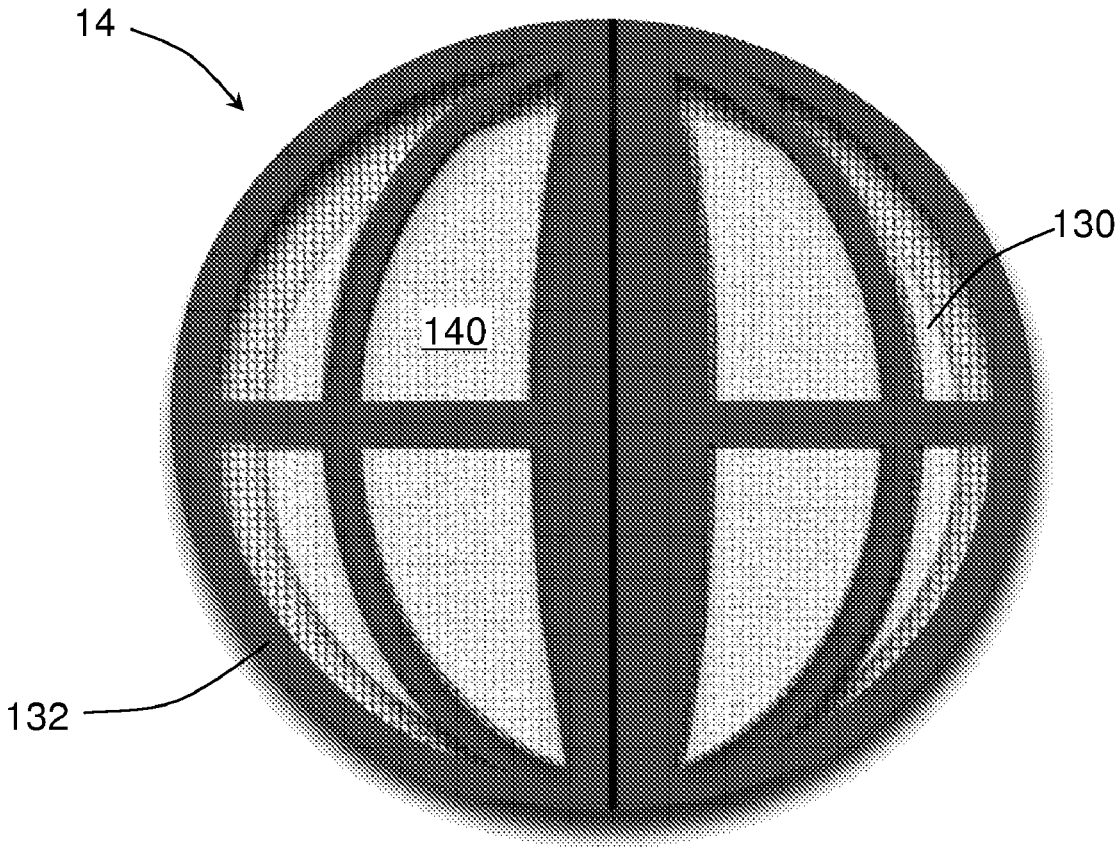
FIG. 8 is a front view of another porous enclosure that houses the multiuse cleaning device having an integral liner.

It is presently preferred to use an elastic, porous liner 140 in combination with the porous enclosure 14, as shown in FIG. 8. The liner helps moderate dissolution of the cleaning agent. It also prevents direct contact between the cleaning agent and clothing. The liner 140 may be integral with the porous enclosure 14 or it may be separate. The liner may be similar to the enclosure 14 shown and described in relation to FIG. 3 which fits tightly around the solid cleaning agent. Being elastic, the liner preferably shrinks in size as the cleaning agent dissolves.

In further embodiments, the enclosure 14 may also be configured such that it performs one or more of the following functions:

(1) retains fragrance with the cleaning agent;

(2) regulates sudsing (lather) during operation of the cleaning machine;

(3) creates drag in the water to quiet any contact with the agitator/cleaning agent and cleaning machine;

(4) retains fragments of the cleaning agent;

(5) creates a barrier between the cleaning agent and the clothes (which prevents/reduces discoloration of the clothes); and/or (6) provides a more consistent dissolution rate of the cleaning device over multiple wash/rinse cycles.

Of course, the enclosure 14 may perform other functions depending on factors such as the construction of the enclosure, the size of the enclosure, etc.

In dishwasher applications, the porous enclosure may be configured as a dispenser which houses the solid cleaning agent. The exact configuration of the dispenser apparatus may be varied, but it should hold the solid cleaning agent, allow a portion of the wash water to contact the cleaning agent, and then drain the treated water into the dishwasher. FIGS. 9A-9D and 10A-10C illustrate two possible dispensers for use with a multiuse cleaning device within the scope of the present invention. The dispenser 150 includes an interior chamber 152 to house a quantity of solid cleaning agent. The dispenser 150 may include an internal baffling system 154 to reduce direct water-flow into the dispenser. Instead water enters the dispenser indirectly to contact and release a quantity of the solid cleaning agent into the water. The dispenser may provide air spacing 156 in its outer structure. It is presently preferred to mold the cleaning agent into a configuration that fits tightly within the interior chamber 152.

The internal baffling system 154 can be in a variety of different configurations. The exact configuration is not essential to the function and operation of the dispenser 150. The dispenser 150 shown in FIGS. 8A-8D illustrates an internal baffling system 154 having an end cap 160 and a perforated screen 162 with a mesh-like structure. The end cap 160 has a drain opening 164. The perforated screen 162 freely allows passage of water, but prevents large particles for entering or exiting the dispenser. The perforated screen 162 provides a support surface for solid cleaning agent. In one embodiment, the perforated screen 162 comprises a grid-work of holes having a size of 9/64 inch. The perforated screen may provide sufficient baffling functionality that additional baffling structures are not required.

Figure 9A:
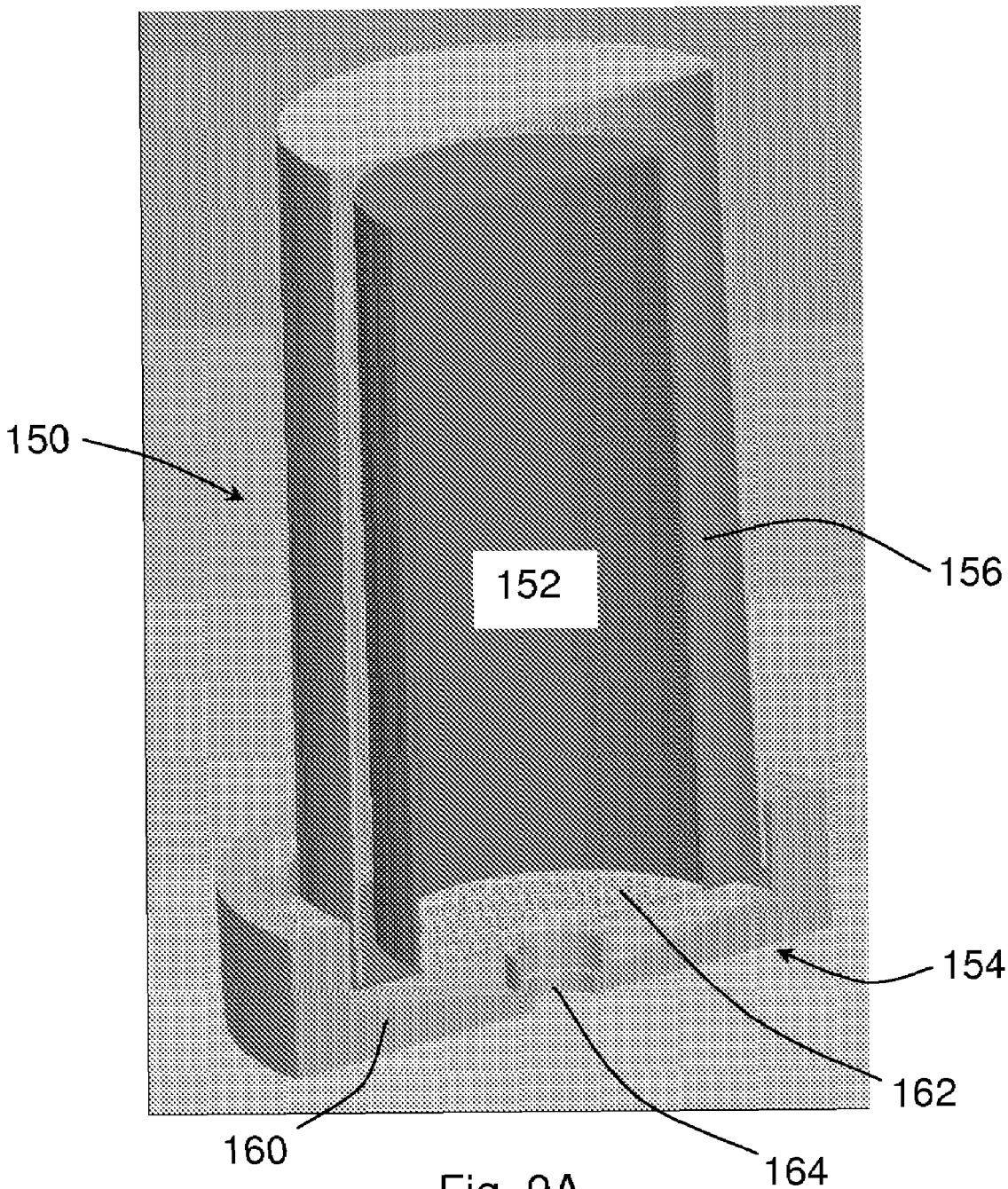
FIG. 9A is a cross-sectional perspective view of a dispenser for use with a multiuse cleaning device.
Figure 9B:
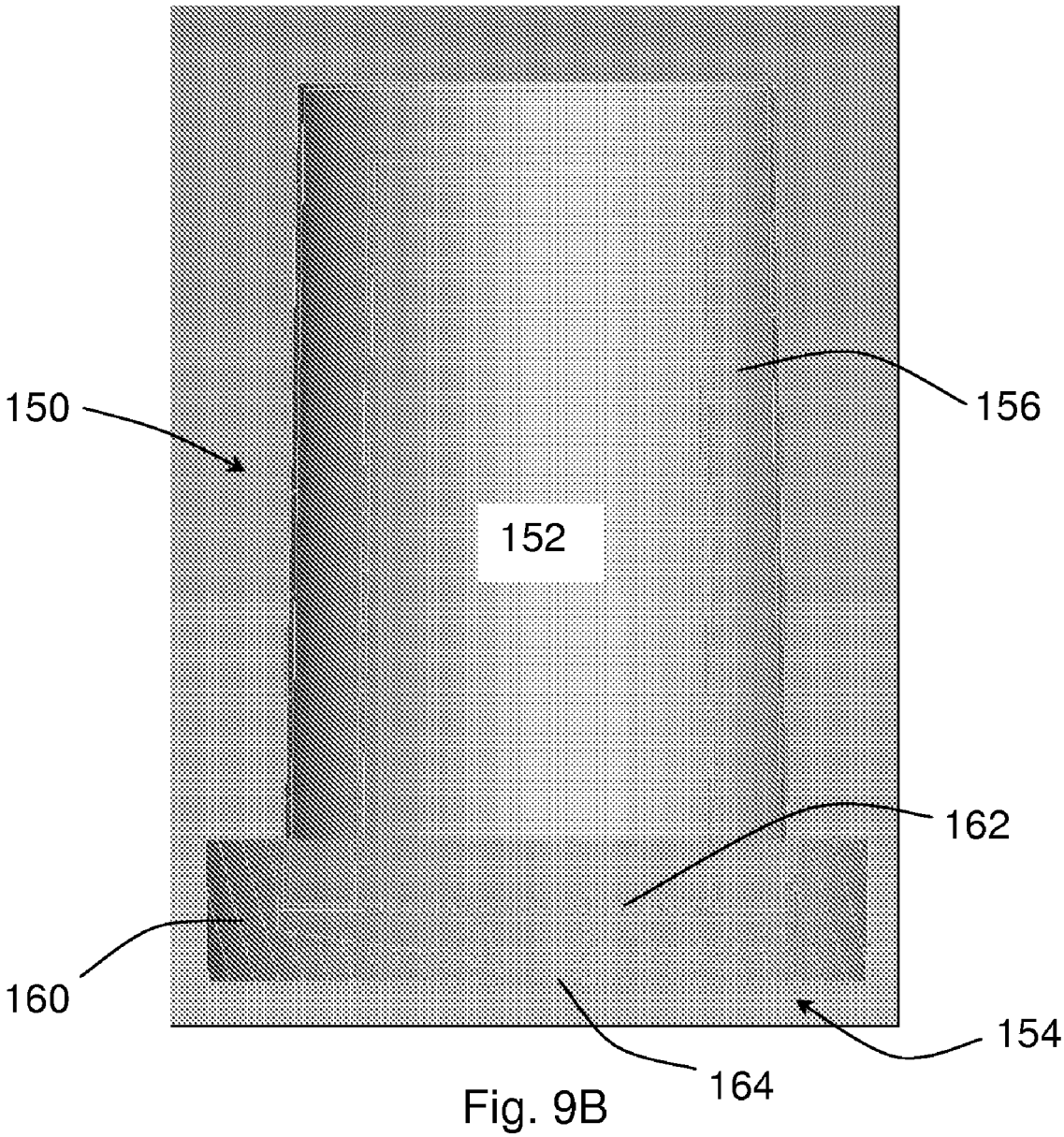
FIG. 9B is a cross-sectional view of the dispenser of FIG. 9A.
Figure 9C:
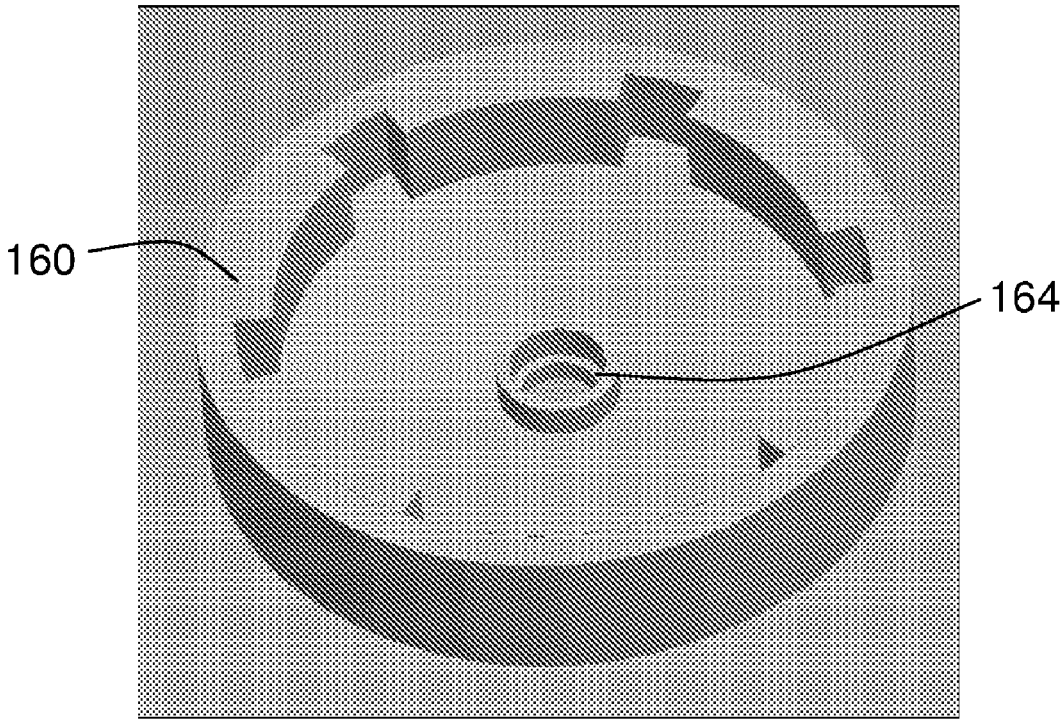
FIG. 9C is a perspective view of an internal baffling system end cap of the dispenser of FIG. 9A.
Figure 9D:
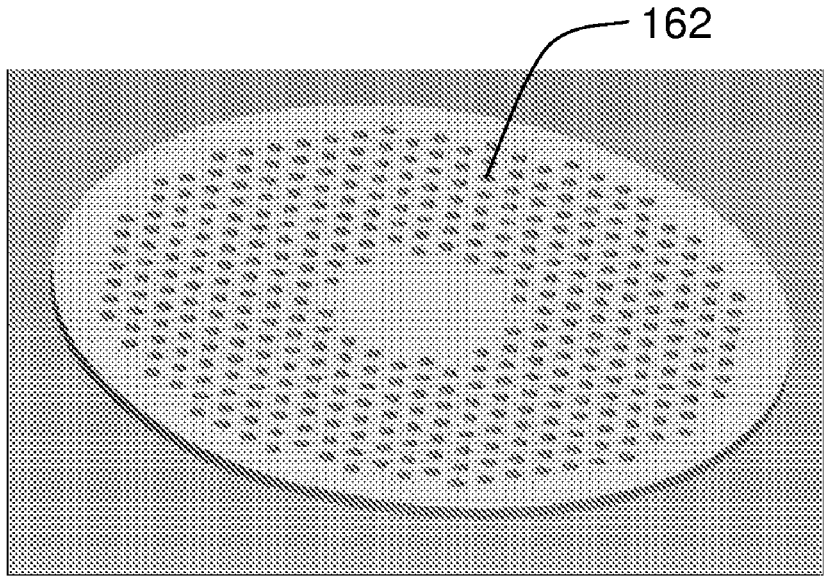
FIG. 9D is a perspective view of a perforated screen used in the internal baffling system of the dispenser of FIG. 8A.
Figure 10A:
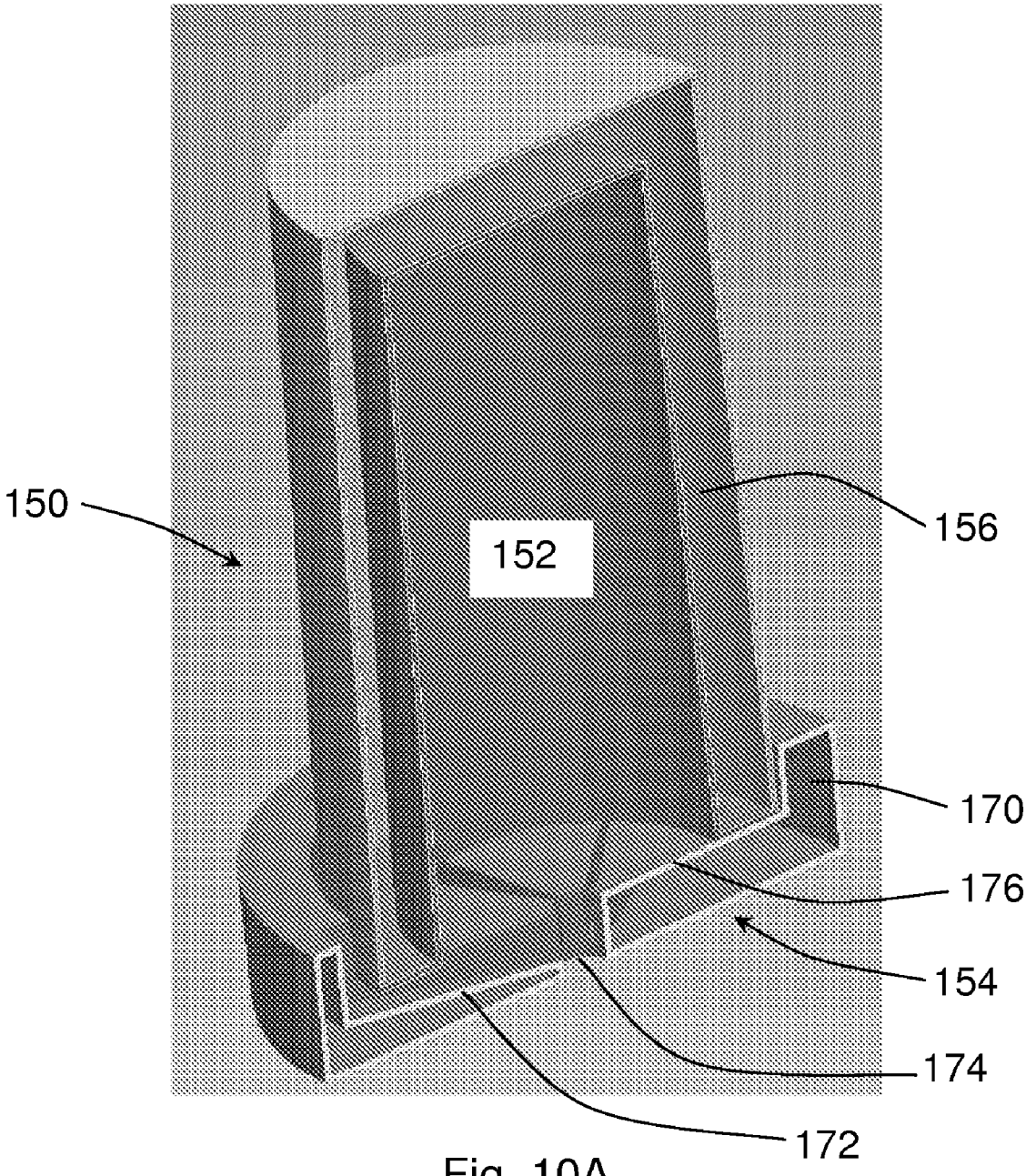
FIG. 10A is a cross-sectional perspective view of another dispenser for use with a multiuse cleaning device.
Figure 10B:
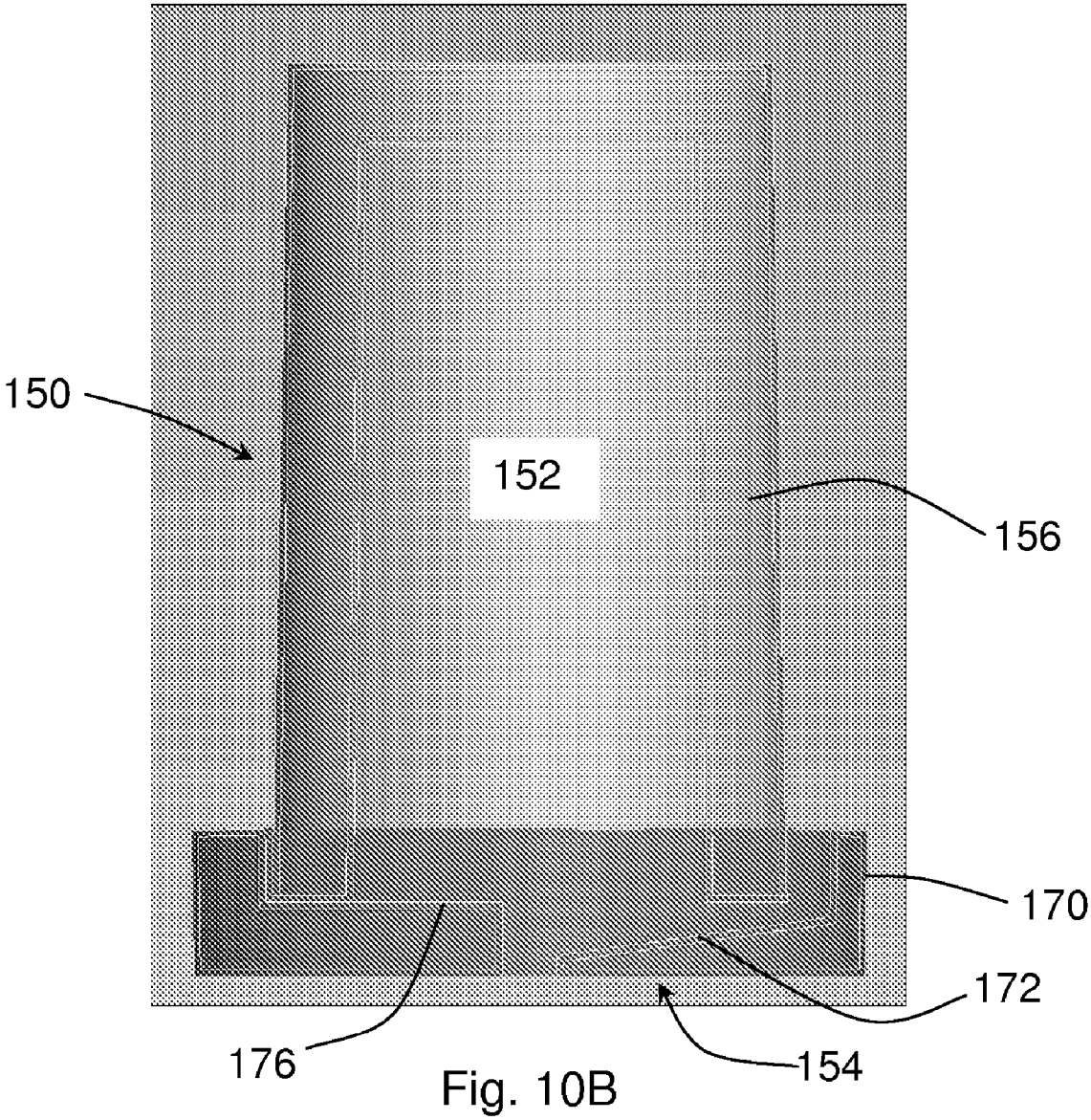
FIG. 10B is a cross-sectional view of the dispenser of FIG. 10A.
Figure 10C:
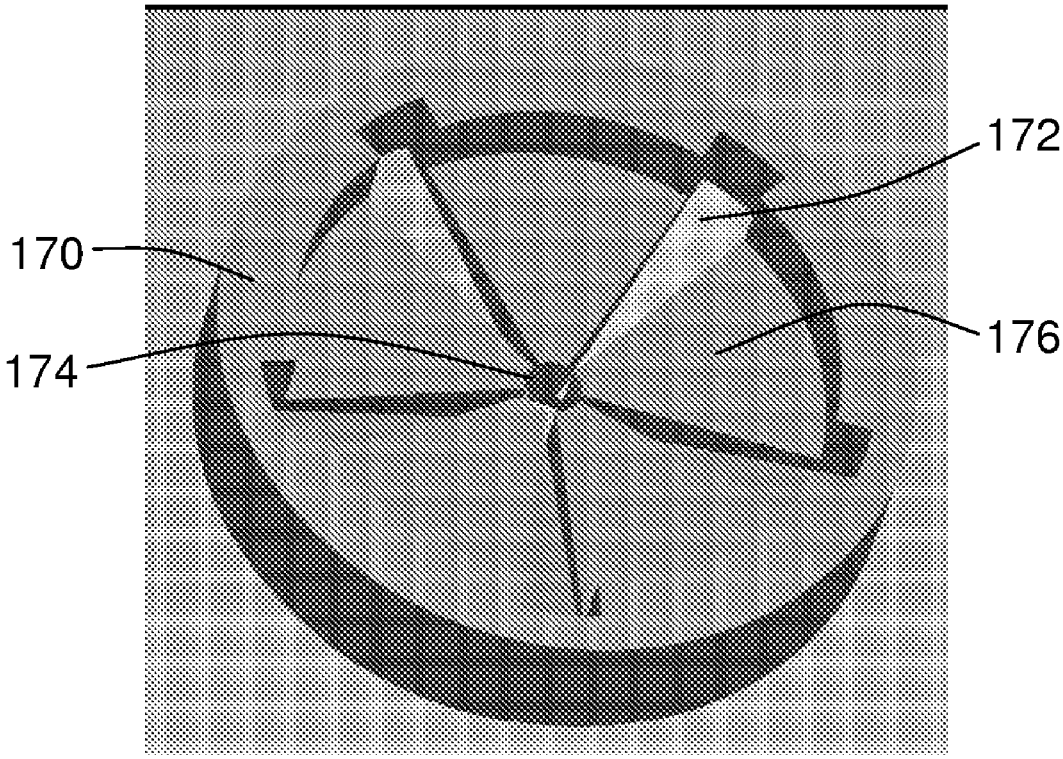
FIG. 10C is a perspective view of an internal baffling system end cap of the dispenser of FIG. 10A.

FIGS. 9A-9C illustrate another dispenser 150 having a different internal baffling system 154 comprising an end cap 170. End cap 170 includes a plurality of drainage channels 172 which slope downward towards drain opening 174. The drainage channels 172 are disposed between adjacent support surfaces 176 which provide support for the solid cleaning agent.

In one embodiment within the scope of the present invention, it may be advantageous to mold the solid cleaning agent within a thin polymeric sleeve, such as polypropylene. The sleeve will have an open end with a removable label or covering. In operation, the user may remove the label and place the solid cleaning agent within the dispenser 150. The internal baffling system 154 allows for water-flow around the bottom/exposed portion of the solid cleaning agent to carry away dissolved cleaning agent. The dispenser 150 is preferably constructed of an inert plastic material that can be disposed within or attached to the interior of the dishwashing machine. For convenience, it may be placed on either the top or bottom rack within the dishwasher according to the user's preference. If necessary, screws, clips, brackets, adhesives, magnets, or any other suitable attachment mechanism may be used to secure the apparatus to the interior of the dishwasher.

EXAMPLES

The following examples are given to illustrate various embodiments within the scope of the present invention. These are given by way of example only, and it is to be understood that the following examples are not comprehensive or exhaustive of the many embodiments within the scope of the present invention.

Example 1

A cleaning agent composition was prepared by mixing the dry ingredients listed in Table 1A with the wet ingredients listed in Table 1B:

TABLE 1A

| Dry Ingredients | Weight (g) | Weight Percent |
|---|---|---|
| Sodium perborate monohydrate | 230 g | 45.5 |
| Optical brightener | 5 g | 1.0 |
| Anti-redeposition agent | 5 g | 1.0 |
| Zeolite | 15 g | 3.0 |
| Fragrance | 22 g | 2.2 |
| Total: | 267 g | 52.7 |

TABLE 1B

| Wet Ingredients | Weight (g) | Weight Percent |
|---|---|---|
| Potassium Silicate | 201 g | 39.8 |
| Sodium hydroxide | 9 g | 1.8 |
| Surfactant | 29 g | 5.7 |
| Total: | 239 g | 47.3 |

After the foregoing ingredients are mixed, the mixture is poured into a mold and allowed to cure and solidify.

Example 2

A multiuse laundry cleaning device in a solid state was prepared by molding cleaning agent having the formula of Example 1 into a spherical ball. The spherical ball was placed inside a washing machine tub and subjected to repeated wash cycles in the washing machine tub. Additional multiuse laundry cleaning devices were prepared and tested in several different types of commercially available washing machines. Wash cycles ranged from delicate to regular to heavy duty, and different water temperature settings were used. The multiuse laundry cleaning device remained in the washing machine tub for both wash and rinse cycles. After the cleaning cycles were complete, the cleaning device was removed from the washing machine and weighed to determine the quantity of cleaning agent that was dissolved during the preceding wash cycle. Representative results from two tests are reported in Tables 2A and 2B.

TABLE 2A

| Wash Cycle | Cleaning Device Weight (g) | Cleaning Agent Released |
|---|---|---|
| 0 | 422 | |
| 1 | 394 | 28 |
| 2 | 336 | 58 |
| 3 | 283 | 53 |
| 4 | 231 | 52 |
| 5 | 189 | 42 |
| 6 | 164 | 25 |
| 7 | 129 | 35 |
| 8 | 99 | 30 |
| 9 | 76 | 23 |
| 10 | 64 | 12 |
| 11 | 44 | 20 |
| 12 | 35 | 9 |
| 13 | 30 | 5 |
| 14 | 27 | 3 |
| 15 | 21 | 6 |

TABLE 2B

| Wash Cycle | Cleaning Device Weight (g) | Cleaning Agent Released |
|---|---|---|
| 0 | 435 | |
| 1 | 389 | 46 |
| 2 | 335 | 54 |
| 3 | 283 | 52 |
| 4 | 236 | 47 |
| 5 | 206 | 30 |
| 6 | 171 | 35 |
| 7 | 145 | 26 |
| 8 | 134 | 11 |
| 9 | 124 | 10 |
| 10 | 102 | 22 |

The average amount of cleaning agent released per wash cycle in Table 2A over 10 wash cycles was 35.8 g. The average amount of cleaning agent released per wash cycle in Table 2B over 10 wash cycles was 33.3.

Results from a test with more wash cycles are reported in Table 2C below:

TABLE 2C

| Wash Cycle | Cleaning Device Weight (g) | Cleaning Agent Released |
|---|---|---|
| 0 | 430 | |
| 1 | 401 | 29 |
| 2 | 366 | 35 |
| 3 | 336 | 30 |
| 4 | 306 | 30 |
| 5 | 281 | 25 |
| 6 | 252 | 29 |
| 7 | 238 | 14 |
| 8 | 218 | 20 |
| 9 | 193 | 25 |
| 10 | 179 | 14 |
| 11 | 157 | 22 |
| 12 | 137 | 20 |
| 13 | 122 | 15 |
| 14 | 103 | 19 |
| 15 | 78 | 25 |
| 16 | 64 | 14 |
| 17 | 46 | 18 |
| 18 | 31 | 15 |
| 19 | 11 | 20 |

Figure 11:
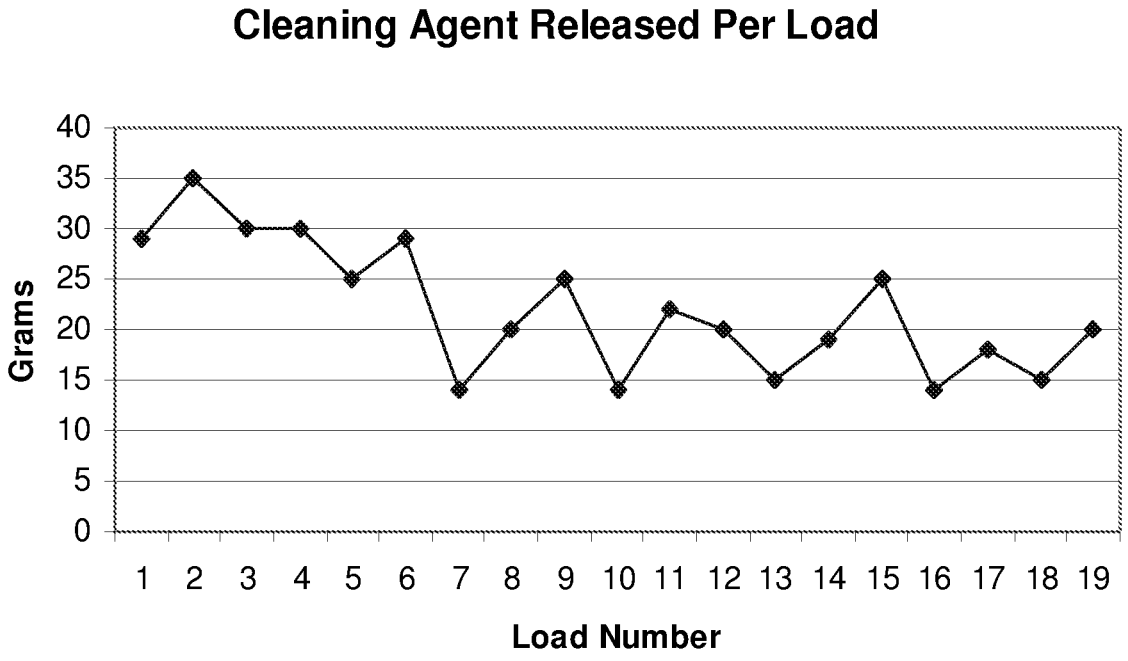
FIG. 11 is a graph of cleaning agent released per load for the results reported in Table 2C.

The average amount of cleaning agent released per wash cycle in Table 2C over 19 wash cycles was 22.1 g. A graph of the results shown in Table 2C, grams of cleaning agent released per wash cycle load, is shown in FIG. 11.

A cleaning agent composition within the scope of the present invention has the following ingredients set forth in Table 3:

TABLE 3

| Ingredient | Weight Percent |
|---|---|
| Sodium Perborate Monohydrate | 37.0% |
| Sodium Carbonate | 31.2% |
| Natural Zeolite | 8% |
| Optical Brightener | 1.0% |
| Potassium silicate | 22.8% |

With the formula of Table 3, ingredients were added as listed. The powders (first four items) were combined and mixed prior to adding liquid potassium silicate. After adding the potassium silicate, the product was mixed briefly and poured into a mold. Set-up and hardening began within twenty minutes after the addition of the potassium silicate at room temperature.

The sodium perborate monohydrate and the sodium carbonate both release gas. The carbonate releases carbon dioxide and the perborate releases oxygen. The potassium silicate provides some solubility control. The sodium carbonate serves a dual role as gas releaser and alkalinity agent.

It has been found that potassium silicate may be used successfully, while sodium silicate is noticeably less-effective to prepare the cleaning agent. While not being bound by theory, it is believed that potassium silicate is operative because it does not raise the pH too high and does not dissolve in water as readily as sodium silicate. Potassium silicate has a pH of about 11, whereas sodium silicate has a pH of about 13. With this information, it may be possible to include a suitable pH modifier with sodium silicate to successfully prepare the cleaning agent.

Yet another cleaning agent composition within the scope of the present invention has the following ingredients set forth in Table 4:

TABLE 4

| Ingredient | Weight Percent |
|---|---|
| Sodium Percarbonate | 38% |
| Sodium Carbonate | 25% |
| Carboxymethylcellulose | 1% |
| Natural Zeolite | 8% |
| Potassium silicate | 28% |

With the formula of Table 4, ingredients were added as listed. The powders (first four items) were combined and slowly mixed to minimize dusting, but mixed briskly enough to ensure total dispersion. The liquid potassium silicate was added slowly with the mixer running. As the product thickened, a small amount of base (sodium hydroxide, less than 0.5 weight percent) was added to aid in processing by thinning the material and allowing a longer mix time. After about 5 to 10 minutes, the product started to stiffen, and it was poured into a mold for curing. Set-up and hardening began within ten minutes after the addition of the potassium silicate at room temperature.

The carboxymethylcellulose is a soil anti-redeposition compound. The sodium percarbonate and the sodium carbonate both release gas. The carbonate releases carbon dioxide and the percarbonate releases oxygen. The potassium silicate provides some solubility control. The sodium carbonate serves a dual role as gas releaser and alkalinity agent. The amounts listed in Table 4 can be varied by a few weight percent.

Another cleaning agent composition within the scope of the present invention has the following ingredients set forth in Table 5:

TABLE 5A

| Dry Ingredients | Weight Percent |
|---|---|
| Gas-releasing Agent | 44.2% |
| Anti-redeposition Agent | 0.9% |
| Optical brightener | 2.1% |
| Sodium Citrate | 4.4% |
| Fragrance (fresh linen) | 1.7% |

TABLE 5B

| Wet Ingredients | Weight Percent |
|---|---|
| Potassium silicate | 30.0% |
| Deionized Water | 11.0 |
| Surfactant | 4.1% |
| Alkalinity Agent | 1.5% |

The cleaning agent disclosed in Table 5 is made in accordance with the procedures of Example 1 outlined above. The amounts listed in Table 5 can be varied by a few weight percent.

In Table 5, the gas-releasing agent was sodium perborate monohydrate. The anti-redeposition agent was carboxymethylcellulose. The potassium silicate provides some solubility control. The alkalinity agent was sodium hydroxide (25%). The optical brightener was Tinopal CBS-X, which is made and available from the Ciba Specialty Chemicals, Inc. The surfactant included two surfactants: sorbitan monooleate and Calsoft F-90, which is available from the Pilot Chemical Co.

Another cleaning agent composition within the scope of the present invention has the following ingredients set forth in Table 6:

TABLE 6A

| Dry Ingredients | Weight Percent |
|---|---|
| Gas-releasing Agent | 43.7% |
| Anti-redeposition Agent | 1.0% |
| Optical brightener | 1.0% |
| Natural Zeolite-40 mesh | 3.2% |
| Fragrance-linen | 3.0% |

TABLE 6B

| Wet Ingredients | Weight Percent |
|---|---|
| Surfactant | 1.9% |
| Potassium silicate | 43.7% |
| Sodium hydroxide-25% | 2.5% |

The cleaning agent disclosed in Table 6 is made in accordance with the procedures of Example 1 outlined above. The amounts listed in Table 6 can be varied by a few weight percent.

In Table 6, the anti-redeposition agent was carboxymethylcellulose. The gas-releasing agent was sodium perborate monohydrate. The potassium silicate provides some solubility control. The alkalinity agent was sodium hydroxide. The optical brightener was Tinopal, which is made and available from the Ciba Specialty Chemicals, Inc. The surfactant was Calsoft F-90, which is available from the Pilot Chemical Co.

Additional tests were also done regarding the dissolution of the cleaning agent in the washing machine. In these tests, the laundry cleaning device remained in the washing machine tub for both wash and rinse cycles. After the cleaning cycles were complete, the cleaning device was removed from the washing machine and weighed to determine the quantity of cleaning agent that was dissolved during the preceding wash cycle. Representative results from two tests are reported in Tables 7A-7G.

TABLE 7A

| Wash Cycle | Cleaning Device Weight (g) | Cleaning Agent Released (g) |
|---|---|---|
| 0 | 430 | 0 |
| 1 | 430 | 35 |
| 2 | 395 | 30 |
| 3 | 365 | 30 |
| 4 | 335 | 25 |
| 5 | 310 | 29 |
| 6 | 281 | 14 |
| 7 | 267 | 20 |
| 8 | 247 | 25 |
| 9 | 222 | 14 |
| 10 | 208 | 22 |
| 11 | 186 | 20 |
| 12 | 166 | 15 |
| 13 | 151 | 19 |
| 14 | 132 | 25 |
| 15 | 107 | 14 |
| 16 | 93 | 18 |
| 17 | 75 | 15 |
| 18 | 60 | 20 |
| 19 | 40 | 40 |

Figure 12A:
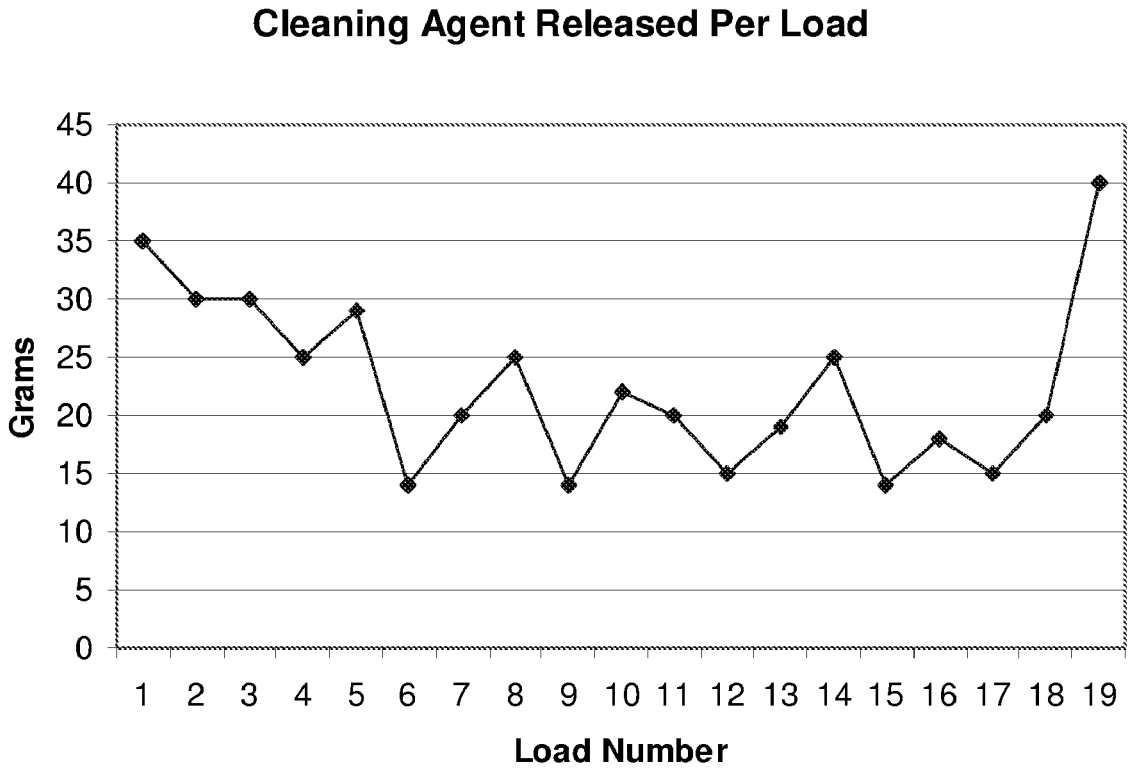
FIGS. 12A-12G are graphs of cleaning agent released per load for the results reported in Tables 7A-7G.

The average amount of cleaning agent released per wash cycle in Table 7A over 19 wash cycles was 22.6 grams. A graph of the results shown in Table 7A, grams of cleaning agent released per wash cycle load, is shown in FIG. 12A.

Results from another test with more wash cycles are reported in Table 7B below. These tests were done with a warm wash and a cold rinse cycle.

TABLE 7B

| Wash Cycle | Cleaning Device Weight (g) | Cleaning Agent Released (g) |
|---|---|---|
| 0 | 680 | 0 |
| 1 | 680 | 13 |
| 2 | 667 | 13 |
| 3 | 654 | 13 |
| 4 | 641 | 11 |
| 5 | 630 | 14 |
| 6 | 616 | 19 |
| 7 | 587 | 20 |
| 8 | 567 | 25 |
| 9 | 542 | 14 |
| 10 | 528 | 12 |
| 11 | 516 | 13 |
| 12 | 503 | 15 |
| 13 | 488 | 17 |
| 14 | 471 | 11 |
| 15 | 460 | 14 |
| 16 | 446 | 18 |
| 17 | 428 | 15 |

TABLE 7B-continued

| Wash Cycle | Cleaning Device Weight (g) | Cleaning Agent Released (g) |
|---|---|---|
| 18 | 413 | 20 |
| 19 | 393 | 9 |
| 20 | 384 | 6 |
| 21 | 378 | 11 |
| 22 | 367 | 10 |
| 23 | 357 | 10 |
| 24 | 347 | 9 |
| 25 | 338 | 11 |
| 26 | 327 | 16 |
| 27 | 311 | 14 |
| 28 | 297 | 13 |
| 29 | 284 | 10 |
| 30 | 274 | 15 |
| 31 | 259 | 16 |
| 32 | 243 | 22 |
| 33 | 221 | 17 |
| 34 | 204 | 12 |
| 35 | 192 | 9 |
| 36 | 183 | 17 |
| 37 | 166 | 20 |
| 38 | 146 | 15 |
| 39 | 131 | 13 |
| 40 | 118 | 15 |
| 41 | 103 | 8 |
| 42 | 95 | 10 |
| 43 | 85 | 13 |
| 44 | 72 | 6 |
| 45 | 66 | 4 |
| 46 | 62 | |

Figure 12B:
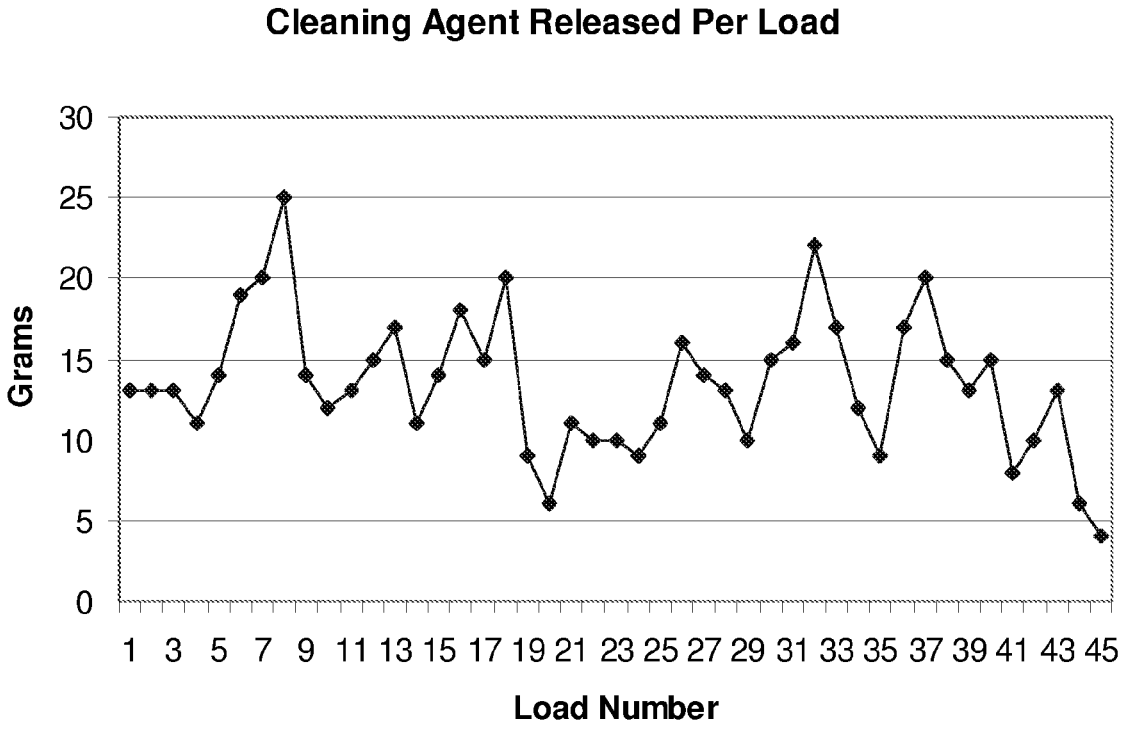

The average amount of cleaning agent released per wash cycle in Table 7B over 46 wash cycles was 13.2 grams. A graph of the results shown in Table 7B, grams of cleaning agent released per wash cycle load, is shown in FIG. 12B.

Results from yet another test with more wash cycles are reported in Table 7C below. These tests were done with a cold wash and a cold rinse cycle.

TABLE 7C

| Wash Cycle | Cleaning Device Weight (g) | Cleaning Agent Released (g) |
|---|---|---|
| 0 | 680 | 0 |
| 1 | 680 | 14 |
| 2 | 666 | 11 |
| 3 | 655 | 9 |
| 4 | 646 | 10 |
| 5 | 636 | 9 |
| 6 | 627 | 8 |
| 7 | 619 | 7 |
| 8 | 612 | 8 |
| 9 | 604 | 12 |
| 10 | 592 | 6 |
| 11 | 586 | 5 |
| 12 | 581 | 8 |
| 13 | 573 | 11 |
| 14 | 562 | 5 |
| 15 | 557 | 8 |
| 16 | 549 | 13 |
| 17 | 536 | 8 |
| 18 | 528 | 7 |
| 19 | 521 | 10 |
| 20 | 511 | 8 |
| 21 | 503 | 7 |
| 22 | 496 | 11 |
| 23 | 485 | 13 |
| 24 | 472 | 8 |
| 25 | 464 | 7 |
| 26 | 457 | 7 |
| 27 | 450 | 8 |

TABLE 7C-continued

| Wash Cycle | Cleaning Device Weight (g) | Cleaning Agent Released (g) |
|---|---|---|
| 28 | 442 | 10 |
| 29 | 432 | 9 |
| 30 | 423 | 9 |
| 31 | 414 | 7 |
| 32 | 407 | 8 |
| 33 | 399 | 12 |
| 34 | 387 | 11 |
| 35 | 376 | 9 |
| 36 | 367 | 10 |
| 37 | 357 | 11 |
| 38 | 346 | 10 |
| 39 | 336 | 10 |
| 40 | 326 | 9 |
| 41 | 317 | 6 |
| 42 | 311 | 5 |
| 43 | 306 | 7 |
| 44 | 299 | 10 |
| 45 | 289 | 8 |
| 46 | 281 | 9 |
| 47 | 272 | 10 |
| 48 | 262 | 12 |
| 49 | 250 | 9 |
| 50 | 241 | 14 |
| 51 | 227 | 8 |
| 52 | 219 | 9 |
| 53 | 210 | 10 |
| 54 | 200 | 7 |
| 55 | 193 | 7 |
| 56 | 186 | 6 |
| 57 | 180 | 10 |
| 58 | 170 | 11 |
| 59 | 159 | 7 |
| 60 | 152 | 7 |
| 61 | 145 | 5 |
| 62 | 140 | 6 |
| 63 | 134 | 12 |
| 64 | 122 | 10 |
| 65 | 112 | 8 |
| 66 | 104 | 6 |
| 67 | 98 | 10 |
| 68 | 88 | 12 |
| 69 | 76 | 9 |
| 70 | 67 | 9 |
| 71 | 58 | 8 |
| 72 | 50 | 9 |
| 73 | 41 | 8 |
| 74 | 33 | 8 |
| 75 | 25 | |

Figure 12C:
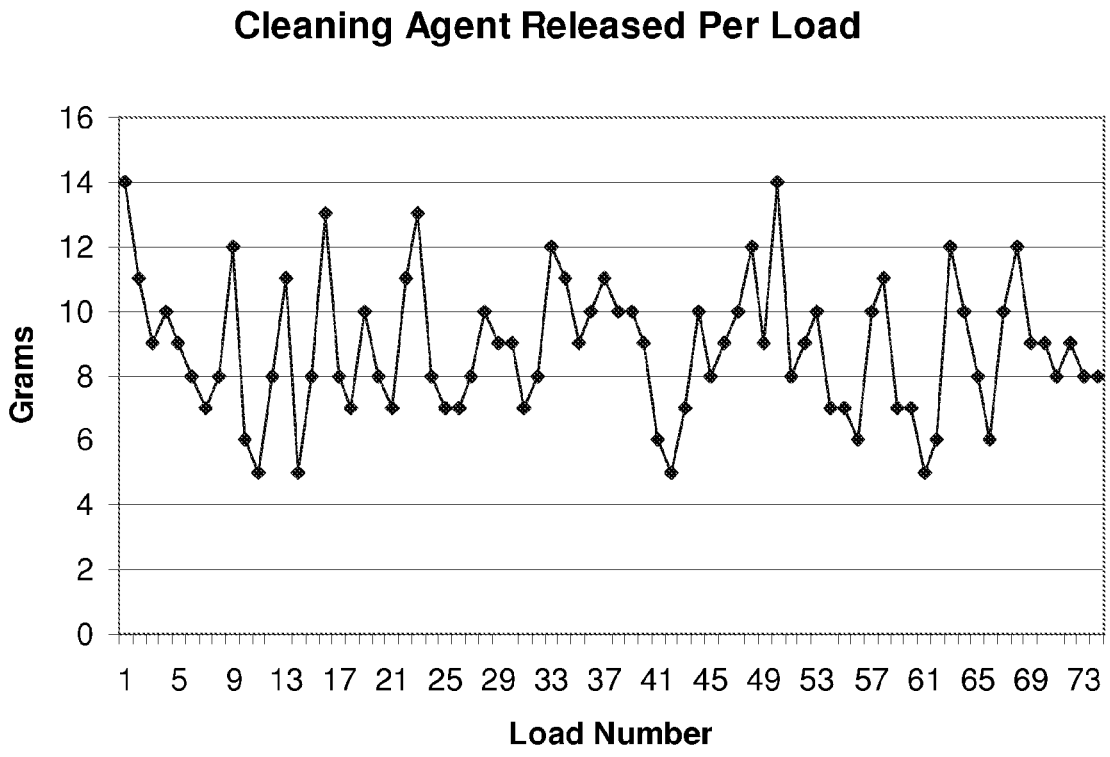

The average amount of cleaning agent released per wash cycle in Table 7C over 75 wash cycles was 8.7 grams. A graph of the results shown in Table 7C, grams of cleaning agent released per wash cycle load, is shown in FIG. 12C.

It is important to note that even though a smaller amount of cleaning agent dissolved in the cold water tests shown in Table 7C, the dissolved cleaning agent in these tests was at least as effective in cleaning the laundry articles as detergents currently available and used in cold water. However, the use of the cleaning agent in exclusively cold water did increase significantly the longevity of the cleaning agent supply. In fact, these results indicate that, in cold water, the cleaning agent may provide adequate results in upwards of 70 wash/rinse cycles.

Results from a further test with multiple wash cycles are reported in Table 7D below. These tests were done with using lower density wash loads using a cold wash and a cold rinse cycle.

TABLE 7D

| Wash Cycle | Cleaning Device Weight (g) | Cleaning Agent Released (g) |
|---|---|---|
| 0 | 450 | 0 |
| 1 | 438 | 12 |
| 2 | 425 | 13 |
| 3 | 414 | 11 |
| 4 | 400 | 14 |
| 5 | 390 | 10 |
| 6 | 378 | 12 |
| 7 | 365 | 13 |
| 8 | 354 | 11 |
| 9 | 343 | 11 |
| 10 | 333 | 10 |
| 11 | 319 | 14 |
| 12 | 306 | 13 |
| 13 | 297 | 9 |
| 14 | 286 | 11 |
| 15 | 274 | 12 |
| 16 | 260 | 14 |
| 17 | 249 | 11 |
| 18 | 239 | 10 |
| 19 | 230 | 9 |
| 20 | 218 | 12 |
| 21 | 205 | 13 |
| 22 | 193 | 12 |
| 23 | 183 | 10 |
| 24 | 171 | 12 |
| 25 | 160 | 11 |
| 26 | 152 | 8 |
| 27 | 142 | 10 |
| 28 | 130 | 12 |
| 29 | 122 | 8 |
| 30 | 109 | 13 |
| 31 | 98 | 11 |
| 32 | 88 | 10 |
| 33 | 79 | 9 |
| 34 | 71 | 8 |
| 35 | 61 | 10 |
| 36 | 55 | 6 |
| 37 | 44 | 11 |
| 38 | 36 | 8 |
| 39 | 30 | 6 |
| 40 | 24 | 6 |

Figure 12D:
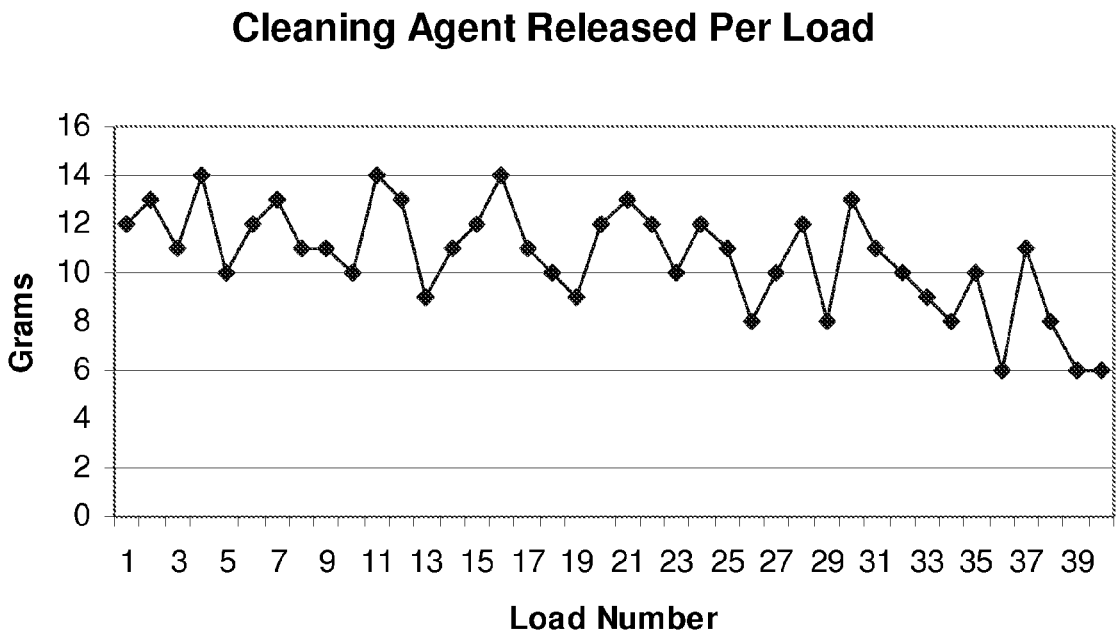

The average amount of cleaning agent released per wash cycle in Table 7D in 40 wash cycles was 10.6 grams. A graph of the results shown in Table 7D, grams of cleaning agent released per wash cycle load, is shown in FIG. 12D.

Results from a further test with multiple wash cycles are reported in Table 7E below. These tests were done with using higher density wash loads using a cold wash and a cold rinse cycle.

TABLE 7E

| Wash Cycle | Cleaning Device Weight (g) | Cleaning Agent Released (g) |
|---|---|---|
| 0 | 450 | 0 |
| 1 | 442 | 8 |
| 2 | 433 | 9 |
| 3 | 425 | 8 |
| 4 | 418 | 7 |
| 5 | 408 | 10 |
| 6 | 400 | 8 |
| 7 | 392 | 8 |
| 8 | 385 | 7 |
| 9 | 379 | 6 |
| 10 | 372 | 7 |
| 11 | 363 | 9 |
| 12 | 355 | 8 |
| 13 | 345 | 10 |

TABLE 7E-continued

| Wash Cycle | Cleaning Device Weight (g) | Cleaning Agent Released (g) |
|---|---|---|
| 14 | 338 | 7 |
| 15 | 332 | 6 |
| 16 | 324 | 8 |
| 17 | 319 | 5 |
| 18 | 312 | 7 |
| 19 | 304 | 8 |
| 20 | 296 | 8 |
| 21 | 287 | 9 |
| 22 | 280 | 7 |
| 23 | 275 | 5 |
| 24 | 266 | 9 |
| 25 | 259 | 7 |
| 26 | 251 | 8 |
| 27 | 245 | 6 |
| 28 | 235 | 10 |
| 29 | 226 | 9 |
| 30 | 218 | 8 |
| 31 | 211 | 7 |
| 32 | 204 | 7 |
| 33 | 193 | 11 |
| 34 | 184 | 9 |
| 35 | 176 | 8 |
| 36 | 166 | 10 |
| 37 | 160 | 6 |
| 38 | 155 | 5 |
| 39 | 147 | 8 |
| 40 | 137 | 10 |
| 41 | 128 | 9 |
| 42 | 121 | 7 |
| 43 | 115 | 6 |
| 44 | 106 | 9 |
| 45 | 99 | 7 |
| 46 | 91 | 8 |
| 47 | 83 | 8 |
| 48 | 77 | 6 |
| 49 | 72 | 5 |
| 50 | 67 | 5 |
| 51 | 61 | 6 |

Figure 12E:
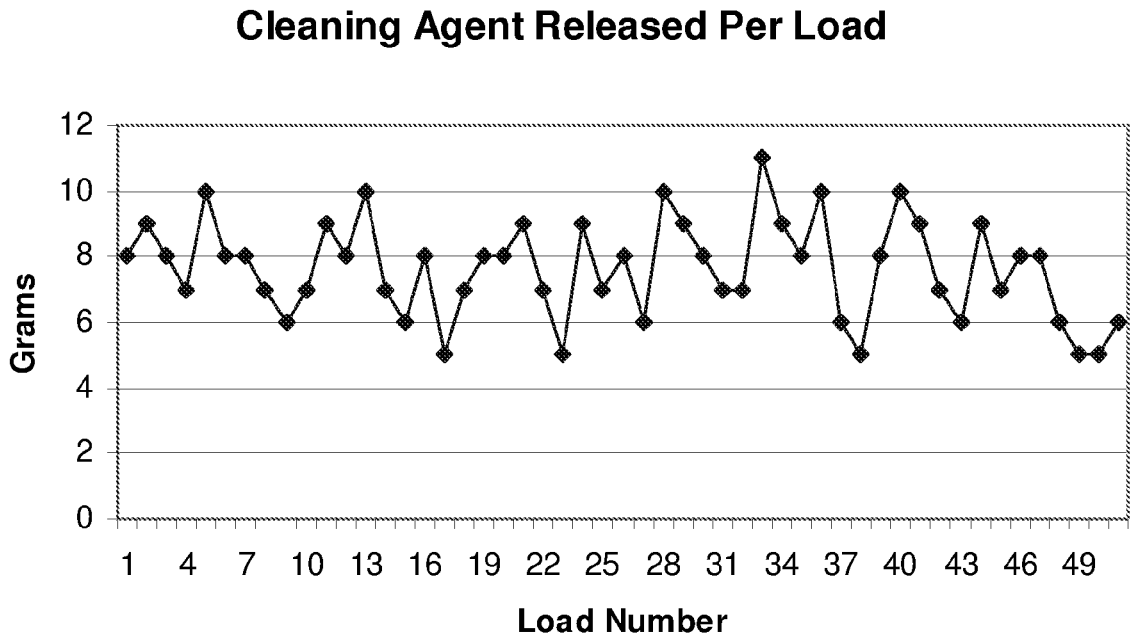

The average amount of cleaning agent released per wash cycle in Table 7E in 51 wash cycles was 7.6 grams. A graph of the results shown in Table 7E, grams of cleaning agent released per wash cycle load, is shown in FIG. 12E.

Results from a further test with multiple wash cycles are reported in Table 7F below. These tests were done with using lower density wash loads using a warm wash and a wash rinse cycle.

TABLE 7F

| Wash Cycle | Cleaning Device Weight (g) | Cleaning Agent Released (g) |
|---|---|---|
| 0 | 450 | 0 |
| 1 | 432 | 18 |
| 2 | 409 | 23 |
| 3 | 388 | 21 |
| 4 | 369 | 19 |
| 5 | 347 | 22 |
| 6 | 323 | 24 |
| 7 | 301 | 22 |
| 8 | 280 | 21 |
| 9 | 263 | 17 |
| 10 | 243 | 20 |
| 11 | 224 | 19 |
| 12 | 202 | 22 |
| 13 | 184 | 18 |
| 14 | 163 | 21 |
| 15 | 149 | 14 |
| 16 | 131 | 18 |

TABLE 7F-continued

| Wash Cycle | Cleaning Device Weight (g) | Cleaning Agent Released (g) |
|---|---|---|
| 17 | 112 | 19 |
| 18 | 90 | 22 |
| 19 | 73 | 17 |
| 20 | 59 | 14 |
| 21 | 48 | 11 |
| 22 | 38 | 10 |

Figure 12F:
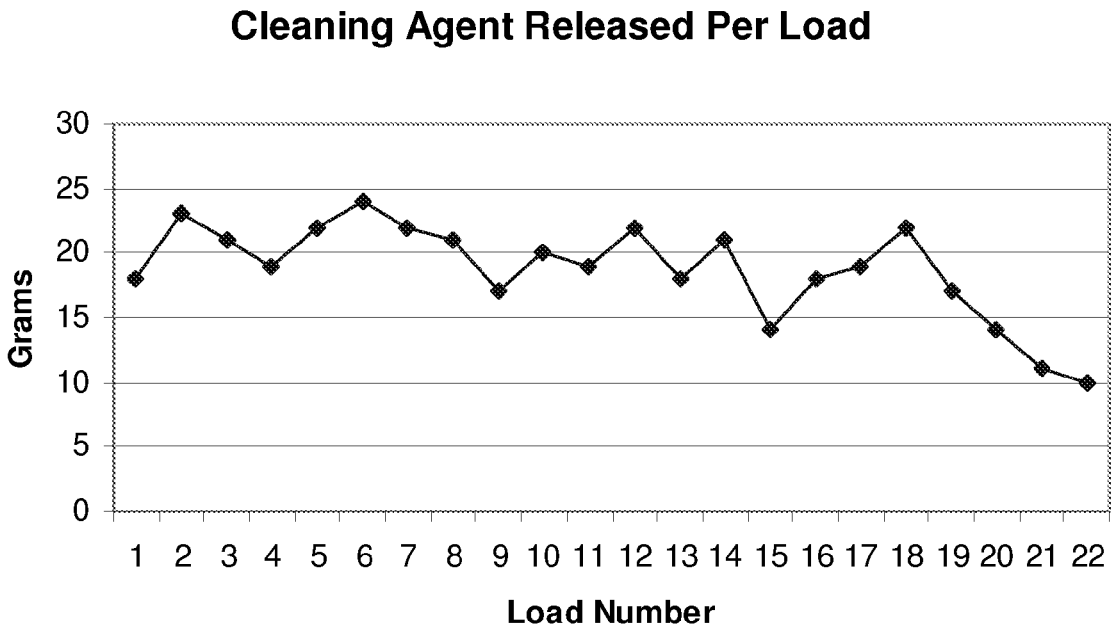

The average amount of cleaning agent released per wash cycle in Table 7F in 22 wash cycles was 18.7 grams. A graph of the results shown in Table 7F, grams of cleaning agent released per wash cycle load, is shown in FIG. 12F.

Results from a further test with multiple wash cycles are reported in Table 7G below. These tests were done with using higher density wash loads using a warm wash and a wash rinse cycle.

TABLE 7G

| Wash Cycle | Cleaning Device Weight (g) | Cleaning Agent Released (g) |
|---|---|---|
| 0 | 450 | 0 |
| 1 | 434 | 16 |
| 2 | 419 | 15 |
| 3 | 401 | 18 |
| 4 | 389 | 12 |
| 5 | 375 | 14 |
| 6 | 364 | 11 |
| 7 | 352 | 12 |
| 8 | 337 | 15 |
| 9 | 325 | 12 |
| 10 | 315 | 10 |
| 11 | 297 | 18 |
| 12 | 284 | 13 |
| 13 | 274 | 10 |
| 14 | 262 | 12 |
| 15 | 248 | 14 |
| 16 | 230 | 18 |
| 17 | 211 | 19 |
| 18 | 197 | 14 |
| 19 | 175 | 22 |
| 20 | 163 | 12 |
| 21 | 146 | 17 |
| 22 | 134 | 12 |
| 23 | 124 | 10 |
| 24 | 113 | 11 |
| 25 | 103 | 10 |
| 26 | 90 | 13 |
| 27 | 82 | 8 |
| 28 | 73 | 9 |
| 29 | 63 | 10 |
| 30 | 56 | 7 |
| 31 | 48 | 8 |
| 32 | 39 | 9 |

Figure 12G:
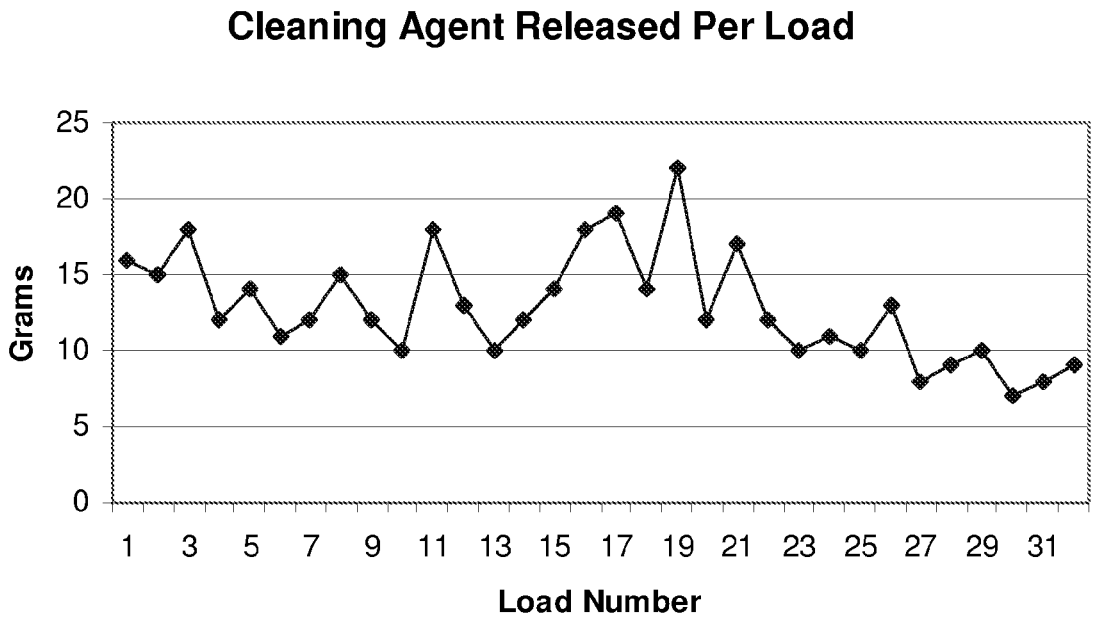

The average amount of cleaning agent released per wash cycle in Table 7G in 32 wash cycles was 18.7 grams. A graph of the results shown in Table 7G, grams of cleaning agent released per wash cycle load, is shown in FIG. 12G.

It has been observed that borax may be included in combination with the perborate to produce a solid cleaning agent that is harder and less soluble in hot environments, such as dishwashers. With significant amounts of borax, the silicate melt is greatly reduced and additional ingredients can be included in the cleaning agent at high concentrations.

Another cleaning agent composition within the scope of the present invention has the following ingredients set forth in Table 8:

TABLE 8

| Ingredient | Weight Percent |
|---|---|
| Sodium Perborate Monohydrate | 32% |
| Anti-redeposition Agent | 1.0% |
| Natural Zeolite | 3% |
| Borax | 11% |
| NaOH (25%) | 3% |
| Potassium silicate | 32% |
| Mirapol | 16% |

Borax ($Na_2B_4O_7$) readily absorbs water to form a pentahydrate ($Na_2B_4O_7.5H_2O$) and decahydrate ($Na_2B_4O_7.10H_2O$) form. Without being bound by theory, it is believed that the borax absorbs water from other ingredients in the cleaning composition to result in a more heat and water resistant composition. Mirapol is a neutralized phosphonocarboxylic acid, solid-surface surfactant that provides sheeting action to reduce film residue on surfaces. The anti-redeposition agent was carboxymethylcellulose.

With the formula of Table 8, ingredients were added as listed. The powders were combined and mixed prior to adding liquid potassium silicate. After adding the potassium silicate, the product was mixed briefly and poured into a mold. It poured thick and set up very fast, making it rock hard very quickly, with no bubbles, and greater resistance to heat and water flow. It was observed that the longer the slurry stays in its liquid state the more bubbles are formed from the decomposition of the perborate. The presence of bubbles allows the cleaning agent to dissolve or breakdown faster in heat.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A method of providing cleaning agent to a cleaning machine comprising:

obtaining a multiuse cleaning device in a solid state comprising a homogeneous quantity of cleaning agent in solid form comprising a gas-releasing component selected from the group consisting of perborates, percarbonates, and mixtures thereof, a potassium silicate solubility control component to limit the solubility of the cleaning agent, wherein the solubility control component is present in an amount sufficient to cause the cleaning agent in solid form to dissolve in water and release a substantially consistent quantity of cleaning agent over a plurality of cleaning wash and rinse cycles; and depositing the cleaning device within a wash chamber of the cleaning machine under conditions such that the cleaning agent in solid form in the cleaning device is exposed to water from the plurality of cleaning wash and rinse cycles.

2. The method according to claim 1, further comprising the step of disposing the solid cleaning agent within a porous enclosure.

3. The method according to claim 2, wherein the porous enclosure comprises a pliable fabric material.

4. The method according to claim 2, wherein the porous enclosure comprises a rubber-like material with a plurality of holes and a plurality of ribs.

5. The method according to claim 4, where a plurality of the ribs intersect at a plurality of the holes.

6. The method according to claim 4, wherein the cleaning agent in solid form is in the form of a ball.

7. The method according to claim 4, wherein the gas-releasing component is present in an amount from 35% to 60% by weight, and wherein the solubility control component is present in an amount from 30% to 60% by weight prior to molding and curing the cleaning agent.

8. The method according to claim 1, wherein the gas-releasing component is present in an amount from 40% to 55% by weight, and wherein the solubility control component is present in an amount from 35% to 50% by weight prior to molding and curing the cleaning agent.

9. The method according to claim 8, wherein the cleaning agent further comprises a water softener present in an amount from 0.5% to 20% by weight, an alkalinity agent present in an amount from 0.5% to 20% by weight, and an optical brightener present in an amount from 0.5% to 8% by weight.

10. The method according to claim 9, wherein the cleaning agent further comprises:

a fragrance component present in an amount from about 0.5 to 15% by weight; and an anti-redeposition component present in an amount from about 0.5% to 10% by weight.

11. The method according to claim 8, wherein the gas-releasing component is sodium perborate monohydrate present in an amount from 42% to 52% by weight, and wherein the solubility control component is potassium silicate present in an amount from 35% to 45% by weight prior to molding and curing the cleaning agent.

12. The method according to claim 9, wherein the water softener is a zeolite present in an amount from 1% to 5% by weight, wherein the alkalinity agent is sodium hydroxide present in an amount from 1% to 5% by weight, and wherein the optical brightener is present in an amount from 0.5% to 3% by weight.

13. The method according to claim 7, further comprising the step of disposing the solid cleaning agent within a porous enclosure.

14. The method according to claim 13, wherein the porous enclosure conforms to the size of the solid cleaning agent as the cleaning agent shrinks in size due to dissolution of cleaning agent.

15. The method according to claim 13, wherein the porous enclosure comprises a rubber-like material with a plurality of holes and a plurality of ribs.

16. The method according to claim 15, where a plurality of the ribs intersect at a plurality of the holes.

17. The method according to claim 1, wherein the substantially consistent quantity of cleaning agent released over the plurality of cleaning wash and rinse cycles is defined as $\overline{X}_{10}\pm50\%$ of $\overline{X}_{10}$, wherein $\overline{X}_{10}$ the average amount of cleaning agent that dissolves during the first 10 wash cycles.

18. The method according to claim 1, wherein the substantially consistent quantity of cleaning agent released over the plurality of cleaning wash and rinse cycles is defined as $\overline{X}_{10}\pm40\%$ of $\overline{X}_{10}$, wherein $\overline{X}_{10}$ the average amount of cleaning agent that dissolves during the first 10 wash cycles.

19. The method according to claim 1, wherein the substantially consistent quantity of cleaning agent released over the plurality of cleaning wash and rinse cycles is defined as $\overline{X}_{10}\pm25\%$ of $\overline{X}_{10}$, wherein $\overline{X}_{10}$ the average amount of cleaning agent that dissolves during the first 10 wash cycles.

20. The method according to claim 1, further comprising the step of retaining the cleaning device deposited within the cleaning machine from one laundry wash and rinse cycle to another laundry wash and rinse cycle.

21. The method according to claim 1, wherein the cleaning agent in solid form dissolves and releases a substantially consistent quantity of cleaning agent over from about 10 to 40 cleaning wash or rinse cycles.

22. The method according to claim 1, wherein the cleaning machine is a laundry machine.

23. The method according to claim 1, wherein the cleaning machine is a dish washing machine.

24. A method of providing cleaning agent to a cleaning machine comprising:

obtaining a multiuse cleaning device in a solid state comprising a homogeneous quantity of cleaning agent in solid form comprising a gas-releasing component selected from the group consisting of perborates, percarbonates, and mixtures thereof, wherein the gas-releasing component is present in an amount from 35% to 60% by weight prior to molding and curing the cleaning agent, a potassium silicate solubility control component to limit the solubility of the cleaning agent, wherein the solubility control component is present in an amount from 30% to 60% by weight prior to molding and curing the cleaning agent, wherein the solubility control component is present in an amount sufficient to cause the cleaning agent in solid form to dissolve in water and release a substantially consistent quantity of cleaning agent over a plurality of cleaning wash and rinse cycles defined as an amount equal to $\overline{X}_{10}\pm50\%$ of $\overline{X}_{10}$, wherein $\overline{X}_{10}$ is the average amount of cleaning agent that dissolves during the first 10 wash cycles, wherein the solid cleaning agent is disposed within a porous enclosure;

depositing the cleaning device within a wash chamber of the cleaning machine under conditions such that the cleaning agent in solid form in the cleaning device is exposed to water from the plurality of cleaning wash and rinse cycles; and retaining the cleaning device deposited within the cleaning machine from one laundry wash and rinse cycle to another laundry wash and rinse cycle.

25. The method according to claim 24, wherein the substantially consistent quantity of cleaning agent released over the plurality of cleaning wash and rinse cycles is defined as $\overline{X}_{10}\pm40\%$ of $\overline{X}_{10}$, wherein $\overline{X}_{10}$ the average amount of cleaning agent that dissolves during the first 10 wash cycles.

26. The method according to claim 24, wherein the substantially consistent quantity of cleaning agent released over the plurality of cleaning wash and rinse cycles is defined as $\overline{X}_{10}\pm25\%$ of $\overline{X}_{10}$, wherein $\overline{X}_{10}$ the average amount of cleaning agent that dissolves during the first 10 wash cycles.

27. The method according to claim 24, wherein the cleaning agent in solid form dissolves and releases a substantially consistent quantity of cleaning agent over from about 10 to 40 cleaning wash or rinse cycles.

28. The method according to claim 24, wherein the cleaning machine is a laundry machine.

29. The method according to claim 24, wherein the cleaning machine is a dish washing machine.

* * * * *